US010934655B2

(12) United States Patent
Kim et al.

(10) Patent No.: US 10,934,655 B2
(45) Date of Patent: Mar. 2, 2021

(54) WASHING MACHINE AND CONTROL METHOD THEREOF

(71) Applicant: SAMSUNG ELECTRONICS CO., LTD., Suwon-si (KR)

(72) Inventors: Seung-Hoon Kim, Seoul (KR); Jung Chul Choi, Hwaseong-si (KR); Sung Mo Lee, Gunpo-si (KR); Jun Hyun Park, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 262 days.

(21) Appl. No.: 16/111,478

(22) Filed: Aug. 24, 2018

(65) Prior Publication Data

US 2019/0062979 A1 Feb. 28, 2019

(30) Foreign Application Priority Data

Aug. 29, 2017 (KR) ..... 10-2017-0109473
Aug. 6, 2018 (KR) ..... 10-2018-0091417

(51) Int. Cl.
*D06F 37/40* (2006.01)
*D06F 23/02* (2006.01)
(Continued)

(52) U.S. Cl.
CPC ..... *D06F 37/40* (2013.01); *D06F 23/02* (2013.01); *D06F 33/00* (2013.01); *D06F 34/18* (2020.02);
(Continued)

(58) Field of Classification Search
CPC ..... D06F 37/40; D06F 37/36; D06F 37/304; D06F 34/18; D06F 23/02; D06F 33/00; D06F 17/08; D06F 21/00
(Continued)

(56) References Cited

U.S. PATENT DOCUMENTS 5,327,603 A 7/1994 Roh et al.
9,708,744 B2 7/2017 Jung et al.
(Continued)

FOREIGN PATENT DOCUMENTS

JP 5-192484 8/1993
JP 11-276777 10/1999
(Continued)

OTHER PUBLICATIONS

European Office Action dated Mar. 17, 2020, in corresponding European Patent Application No. 18191221.3.
(Continued)

*Primary Examiner* — Tinsae B Ayalew
(74) *Attorney, Agent, or Firm* — Staas & Halsey LLP

(57) ABSTRACT

Disclosed herein is a washing machine including: a main body having a laundry inlet in the front portion; a tub disposed in the inside of the main body, and configured to store water; a drum rotatably disposed in the inside of the tub; a pulsator disposed in the inside of the drum, and configured to be rotatable relative to the drum; a motor configured to provide a driving force to the pulsator; and a controller configured to control a current flowing to the motor on the basis of revolution per minute (rpm) of the pulsator rotating by a movement of laundry contained in the drum, and to start controlling the motor on the basis of rpm of the drum.

20 Claims, 17 Drawing Sheets

(51) Int. Cl.

| | |
|---|---|
| ***D06F 37/36*** | (2006.01) |
| ***D06F 33/00*** | (2020.01) |
| ***D06F 34/18*** | (2020.01) |
| *D06F 37/30* | (2020.01) |
| *D06F 17/08* | (2006.01) |
| *D06F 21/00* | (2006.01) |

(52) U.S. Cl.
CPC ..... *D06F 37/36* (2013.01); *D06F 17/08* (2013.01); *D06F 21/00* (2013.01); *D06F 37/304* (2013.01)

(58) Field of Classification Search
USPC ..... 68/53
See application file for complete search history.

(56) References Cited

U.S. PATENT DOCUMENTS

| | | | | |
|---|---|---|---|---|
| 2008/0303463 | A1* | 12/2008 | Darby | H02P 6/22 318/400.09 |
| 2011/0192655 | A1 | 8/2011 | Kim et al. | |
| 2015/0121630 | A1 | 5/2015 | Lee et al. | |
| 2015/0128660 | A1* | 5/2015 | Jung | D06F 37/304 68/3 R |

FOREIGN PATENT DOCUMENTS

| | | |
|---|---|---|
| JP | 2000-14960 | 1/2000 |
| JP | 2014-530741 | 11/2014 |
| JP | 2015-501187 | 1/2015 |
| KR | 10-2005-0087342 | 8/2005 |
| KR | 10-2005-0121009 | 12/2005 |
| KR | 10-2005-0121013 | 12/2005 |
| KR | 10-2005-0121018 | 12/2005 |
| KR | 10-2016-0000643 | 1/2016 |
| WO | WO 2014/190567 A1 | 12/2014 |

OTHER PUBLICATIONS

International Search Report dated Dec. 10, 2018 in International Patent Application No. PCT/KR2018/009990.
European Search Report dated Jan. 14, 2019 in European Patent Application No. 18191221.3.
Korean Patent Office Action issued in Korean Patent Application No. 10-2018-0091417 dated Oct. 20, 2019.
European Patent Office issued Communication pursuant to Article 94(3) EPC in European Patent Application No. 18 191 221.3 dated Jun. 28, 2019.
Korean Office Action dated Apr. 27, 2020, in corresponding Korean Patent Application No. 10-2018-0091417.

* cited by examiner

WASHING MACHINE AND CONTROL METHOD THEREOF

CROSS-REFERENCE TO RELATED APPLICATION

This application is based on and claims priority under 35 U.S.C. § 119 to Korean Patent Applications No. 10-2017-0109473, filed on Aug. 29, 2017, and No. 10-2018-0091417, filed on Aug. 6, 2018 in the Korean Intellectual Property Office, the disclosures of which are incorporated by reference herein in their entireties.

BACKGROUND

1. Field

The present disclosure relates to a washing machine having a pulsator in the inside of a drum, and a method of controlling the washing machine.

2. Description of the Related Art

A washing machine is a home appliance for washing laundry using electric power, and generally, the washing machine includes a tub for storing water, and a drum for generating mechanical energy in the inside of the tub to separate dirt from laundry.

The washing machine is classified into a top-loading type in which the rotation shaft of a drum stands vertically, and a front-loading type in which the rotation shaft of a drum extends horizontally.

The top-loading type rotates a disc-shaped rotation plate disposed on the bottom of a tub to rotate laundry and rub it to thereby separate dirt from the laundry. The top-loading type consumes a large amount of water, and makes laundry tangled since mechanical energy is concentrated on the bottom of the tub. Therefore, the top-loading type has disadvantages that it damages cloth easily and cannot wash laundry uniformly.

In contrast, the front-loading type raises laundry and drops it by rotating the drum, thereby separating dirt from the laundry using a falling force. The front-loading type could overcome the disadvantages of the top-loading type, but has a limitation that it has low washing performance since it washes laundry by a simple method of dropping laundry. Therefore, the front-loading type requires a long washing time in order to overcome the limitation.

In order to overcome the disadvantages of the top-loading type and front-loading type, studies into a technical combination method of adding a pulsator to the front-loading type are conducted. More specifically, the combination method is to provide a pulsator that can rotate independently and a motor for driving the pulsator in the inside of the drum. Also, the combination method controls the drum and the pulsator independently to rotate them in different directions, thereby compensating for the above-described disadvantages of the top-loading type and front-loading type.

However, when the combination method controls the drum and the pulsator without considering the state of laundry contained in the inside of the drum, dehydration ability may be degraded. More specifically, if dehydration is performed while driving the pulsator when the drum contains a small amount of load or when laundry is arranged properly in the inside of the drum, the laundry may be easily tangled by the pulsator. On the contrary, if the pulsator does not operate in the drum in which laundry is arranged improperly, there will be no advantage of the pulsator.

In order to overcome the problem, a dehydration control method required for the front-loading type including the pulsator is proposed.

SUMMARY

Therefore, it is an aspect of the present disclosure to provide a washing machine having a pulsator in the inside of a drum, the washing machine capable of improving ability of dehydrating laundry and preventing noise that is generated by unstable control of the pulsator by controlling a rotation of the pulsator according to a state of a load contained in the inside of the drum, the state of the load changing by a rotation of the drum, and a method of controlling the washing machine.

It is another aspect of the present disclosure to provide a washing machine capable of reducing start-up failure probability and securing a time for recharging a dropped Direct-Current (DC) link voltage by controlling a drum and a pulsator properly to thereby achieve the stability of control, and a method of controlling the washing machine.

Additional aspects of the disclosure will be set forth in part in the description which follows and, in part, will be obvious from the description, or may be learned by practice of the disclosure.

In accordance with an aspect of the present disclosure, there is provided a washing machine including: a main body having a laundry inlet in a front portion of the main body; a tub disposed inside the main body; a drum rotatably disposed inside the tub; a pulsator disposed inside the drum, and being rotatable relative to the drum; a motor configured to provide a driving force to the pulsator, to thereby control rotation of the pulsator; and a controller configured to perform a first control process of controlling a current flowing to the motor, in accordance with rotation of the pulsator by movement of laundry in the drum and that generates counter electromotive force in the motor, to thereby suppress the counter electromotive force, and after performing the first control process, perform a second control process of controlling the motor in accordance with rotation of the drum, to thereby control the driving force provided to the pulsator.

In the first control process, revolution per minute (rpm) of the pulsator may be lower than a reference rpm.

In the second control process, when revolution per minute (rpm) of the pulsator may be higher than or equal to a reference rpm, the controller calculates a rpm compensation ratio on the basis of the rpm of the pulsator and rpm of the drum, and controls the motor in accordance with the calculated compensation ratio, to thereby control the driving force provided to the pulsator.

In the second process, the controller may determine rpm of the motor on the basis of the calculated compensation ratio, and control the motor on the basis of the determined rpm of the motor, to thereby control the driving force provided to the pulsator.

In the second control process, the controller may recalculate the compensation ratio on the basis of a predetermined time period, and control the motor in accordance with the recalculated compensation ratio.

In the second control process, the controller may control the motor in accordance with rotation of the drum by changing revolution per minute (rpm) of the motor in accordance with rpm of the drum.

The washing machine may further include a first driving device configured to rotate the motor; an additional motor to provide a driving force to the drum, to rotate the drum; and a second driving device configured to rotate the additional motor, to thereby control the driving force provided to the drum.

The washing machine may further include a control panel configured to receive a washing operation start command from a user, wherein the controller controls the second driving device and the first driving device sequentially in accordance with the washing operation start command being received by the control panel.

The controller may determine the rotation of the pulsator by movement of laundry in the drum based on current flowing to the motor.

The controller may control the drum and the pulsator such that the drum and the pulsator rotate in different directions.

The controller may change from performing the first control process to performing the second control process when the pulsator is at or above a specific revolution per minute.

The controller may change from performing the first control process to performing the second control process when the drum is at or above a specific revolution per minute.

In accordance with another aspect of the present disclosure, there is provided a method of controlling a washing machine, the washing machine including a drum, a pulsator disposed inside the drum and being rotatable relative to the drum, and a motor configured to provide a driving force to the pulsator to thereby control rotation of the pulsator by the washing machine: performing a first control process of controlling a current flowing to the motor, according to rotation of the pulsator by movement of laundry in the drum and that generates counter electromotive force in the motor, to thereby suppress the counter electromotive force; and after performing the first control process, performing a second control process of controlling the motor in accordance with rotation of the drum, to thereby control the driving force provided to the pulsator.

In the first control process, revolution per minute (rpm) of the pulsator may be lower than a reference rpm.

In the second control process, when revolution per minute (rpm) of the pulsator is higher than or equal to reference rpm, the washing machine may calculate a rpm compensation ratio on the basis of the rpm of the pulsator and rpm of the drum, and control the motor in accordance with the calculated compensation ratio, to thereby control the driving force provided to the pulsator.

In the second control process, the washing machine may determine rpm of the motor on the basis of the calculated compensation ratio; and control the motor on the basis of the determined rpm of the motor, to thereby control the driving force provided to the pulsator in the second control process, the washing machine may recalculate the compensation ratio on the basis of a predetermined time period, and control the motor in accordance with the recalculated compensation ratio.

In the second control process, the washing machine may control the motor in accordance with rotation of the drum by changing revolution per minute (rpm) of the motor in accordance with rpm of the drum.

In the second control process, the washing machine may control the drum and the pulsator so that the drum and the pulsator rotate in different directions.

In accordance with an aspect of the present disclosure, there is provided a washing machine including: a drum that is rotatable; a pulsator disposed inside the drum, and that is rotatable relative to the drum; a motor configured to provide a driving force to the pulsator, to thereby control rotation of the pulsator; and a controller configured to, with a rotation speed of the drum being below a predetermined rotation speed for the drum and a rotation speed of the pulsator being below a predetermined rotation speed for the pulsator, and in response to a rotation of the pulsator that generates a counter electromotive force in the motor, controlling a current flowing to the motor to suppress the counter electromotive force, and when the rotation speed of the drum increases to be above the predetermined rotation speed for the drum, or when the rotation speed of the pulsator rotates to be above the predetermined rotation speed for the pulsator, controlling the motor in accordance with rotation of the drum, to thereby control the driving force provided to the pulsator.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
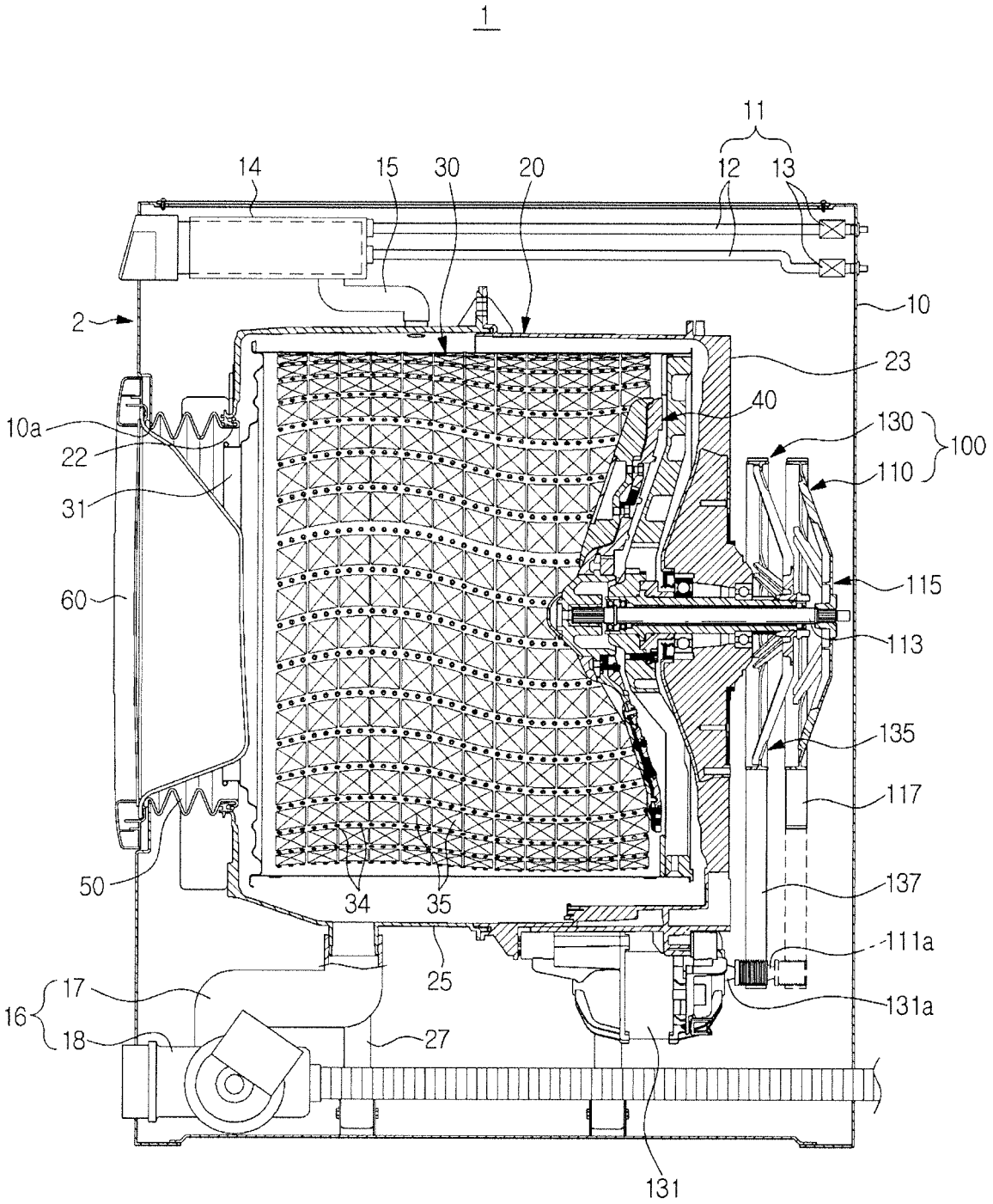
FIG. 1 is a side cross-sectional view showing a schematic configuration of a washing machine according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure.

As used herein, the term "and/or" includes any and all combinations of one or more of associated listed items.

Also, the terms "front direction" and "rear direction", when used in this specification, are defined based on the drawings, and the shapes and locations of the corresponding components are not limited by the terms.

Hereinafter, the embodiments of the present disclosure will be described in detail with reference to the accompanying drawings.

FIG. 1 is a side cross-sectional view showing a schematic configuration of a washing machine according to an embodiment of the present disclosure.

Referring to FIG. 1, a washing machine 1 may include a main body 10 forming an outer appearance of the washing machine 1 and accommodating various components therein, a tub 20 disposed in the inside of the main body 10, a drum 30 accommodating laundry and rotating, a pulsator 40 disposed in the inside of the drum 30, a first driving device 110 for driving the pulsator 40, and a second driving device 130 for driving the drum 30.

The main body 10 may be in the shape of a box. In a front portion 2 of the main body 10, a laundry inlet 10*a* may be formed to allow a user to put laundry into the inside of the drum 30.

The laundry inlet 10*a* of the main body 10 may be opened or closed by a door 60. The door 60 may be rotatably coupled to the main body 10 by a hinge member, and configured with a glass member and a door frame for supporting the glass member.

The glass member may be formed with a transparent tempered glass to allow a user to look in the inside of the main body 10. The glass member may protrude toward the inside of the tub 20 to prevent laundry from being gathered to the door 60.

The tub 20 may store water and may be in the shape of a cylinder. The tub 60 may be supported by a suspension device 27. The tub 20 may include an opening 22 formed in a side of the tub 20 in correspondence to the laundry inlet 10*a* of the main body 10, and a rear portion 23 forming the other side of the tub 20.

In the rear portion 23 of the tub 20, a reinforcing rib 24 (see FIG. 2) may be formed at regular intervals along a radial direction and a circumferential direction in such a way to form a grid pattern. The reinforcing rib 24 may prevent the tub 20 from being bent when the tub 20 is injection-molded, and also prevent a rear wall of the tub 20 from being twisted by a weight transferred to the tub 20 upon washing or dehydrating.

The laundry inlet 10*a* of the front portion 2 of the main body 10 may be connected to the opening 22 of the tub 20 by a diaphragm 50. The diaphragm 50 may form a passage connecting the laundry inlet 10*a* of the main body 10 to the opening 22 of the tub 20, and guide laundry put through the laundry inlet 10*a* to the inside of the drum 30, while preventing vibrations generated when the drum 30 rotates from being transferred to the main body 10. Also, the diaphragm 50 may seal up between the tub 20 and the glass member of the door 60.

The drum 30 may be in the shape of a cylinder whose front portion opens, and may be rotatably disposed in the inside of the tub 20. That is, the drum 30 may include an opening 31 formed in the front portion. The central axis of the drum 30 may be parallel to the central axis of the tub 20.

The drum 30 may rotate in the inside of the tub 20. The drum 30 may rotate to raise laundry and then drop it, thereby washing the laundry. In the circumference of the drum 30, a plurality of through holes 34 may be formed to pass washing water stored in the tub 20. Also, in the circumference of the drum 30, at least one protrusion 35 may protrude toward the inside of the drum 30. The protrusion 35 may rub against laundry when the laundry is washed to improve washing performance.

According to an embodiment, a plurality of through holes 34 and/or a plurality of protrusions 35 may be formed successively along the circumferential surface of the drum 30.

The pulsator 40 may be disposed on a rear inner surface of the drum 30, and may rotate on a rotation shaft. The pulsator 40 may convert a driving force transferred from the first driving device 110 to a rotational force, and rotate laundry.

The rotation shaft of the pulsator 40 may be a rotation shaft of the drum 30. However, according to another embodiment, the rotation shaft of the pulsator 40 may be different from the rotation shaft of the drum 30.

The pulsator 40 may be rotatable relative to the drum 30. That is, the pulsator 40 may rotate in the same direction as the drum 30 or in a different direction from the drum 30. Details about the operation will be described in detail with reference to FIG. 7, later.

A water supply 11 for supplying washing water to the inside of the tub 20 may be disposed above the tub 20. The water supply 11 may be configured with a water supply pipe 12 for supplying washing water from an external water source, and a water supply valve 13 for opening or closing the water supply pipe 12.

In a front upper portion of the main body 10, a detergent supply 14 may be disposed to supply a detergent to the tub 20. The detergent supply 14 may be connected to the tub 20 through a connection pipe 15. Washing water supplied through the water supply pipe 12 may be supplied to the inside of the tub 20 together with a detergent via the detergent supply 14.

The washing machine 1 may include a drain device 16 disposed on the bottom of the tub 20 to drain washing water. The drain device 16 may include a drain pipe 17 connected to the bottom of the tub 20 and configured to guide washing water to the outside of the main body 10, and a drain pump 18 for pumping washing water of the tub 20.

Figure 2:
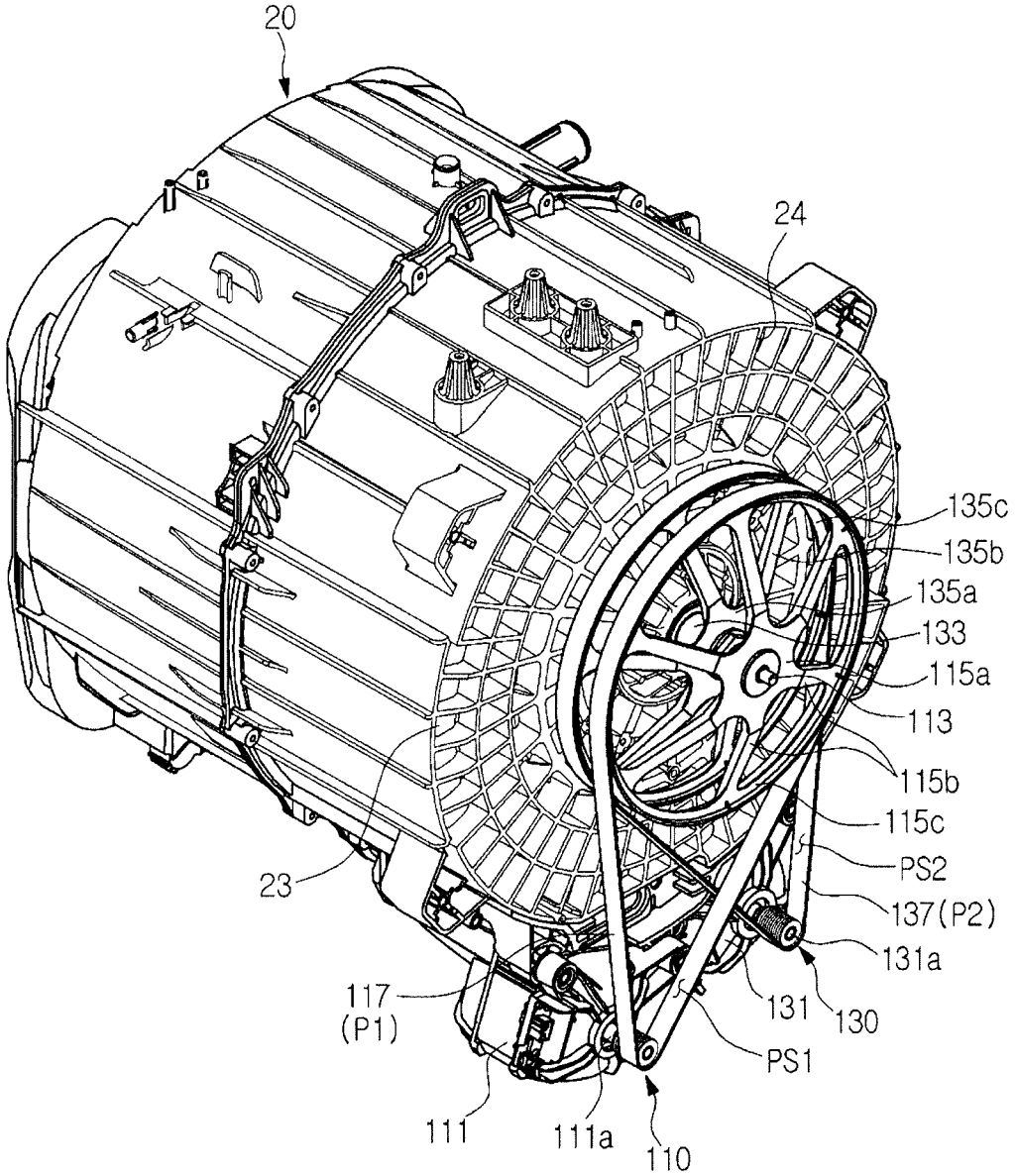
FIG. 2 is a perspective view showing a tub and a driving device of the washing machine shown in FIG. 1.
Figure 3:
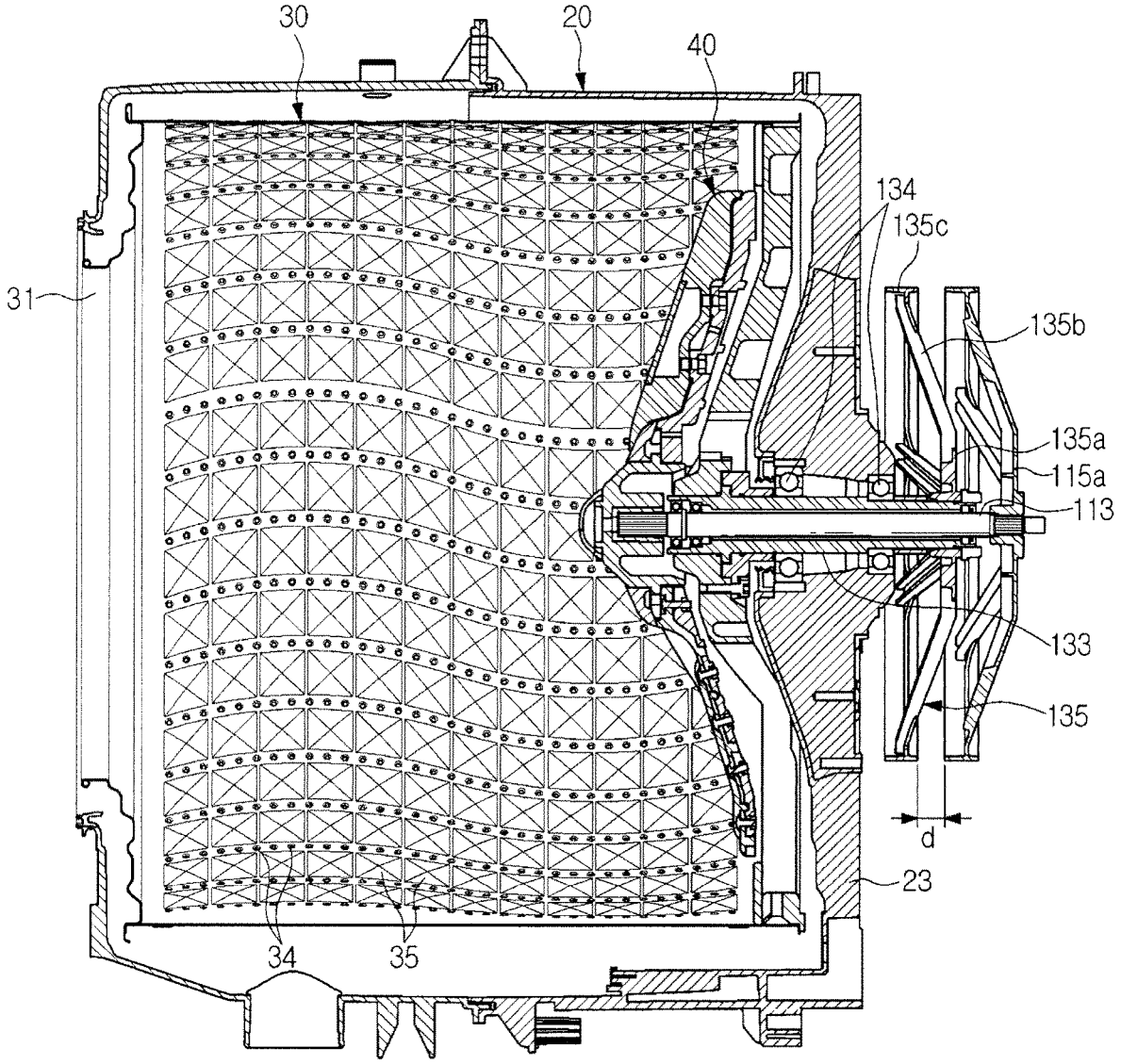
FIG. 3 is a side cross-sectional view showing a drum, a pulsator, and the driving device of the washing machine shown in FIG. 1.
Figure 4:
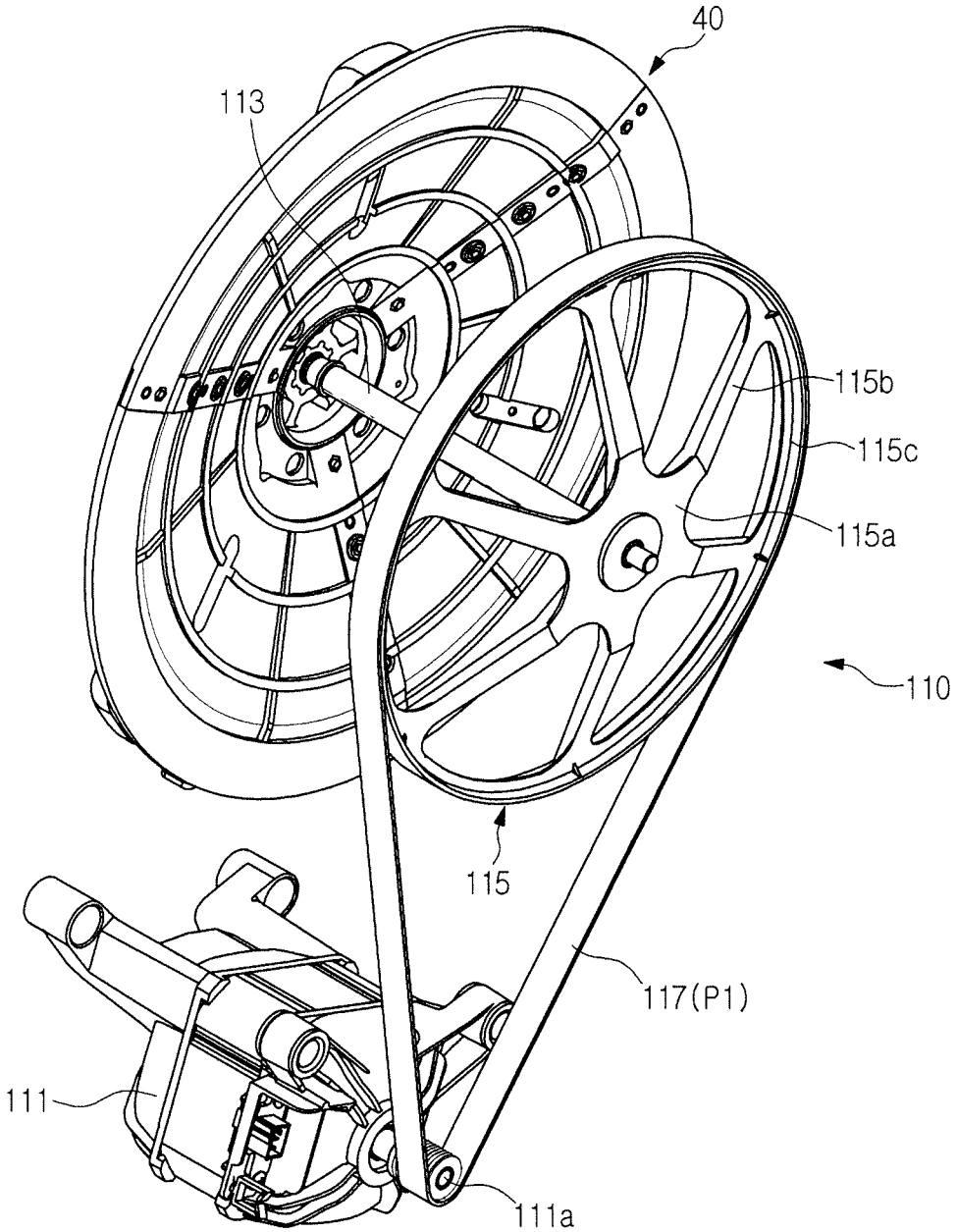
FIG. 4 is a perspective view showing the pulsator and a first driving device of the washing machine shown in FIG. 1.
Figure 5:
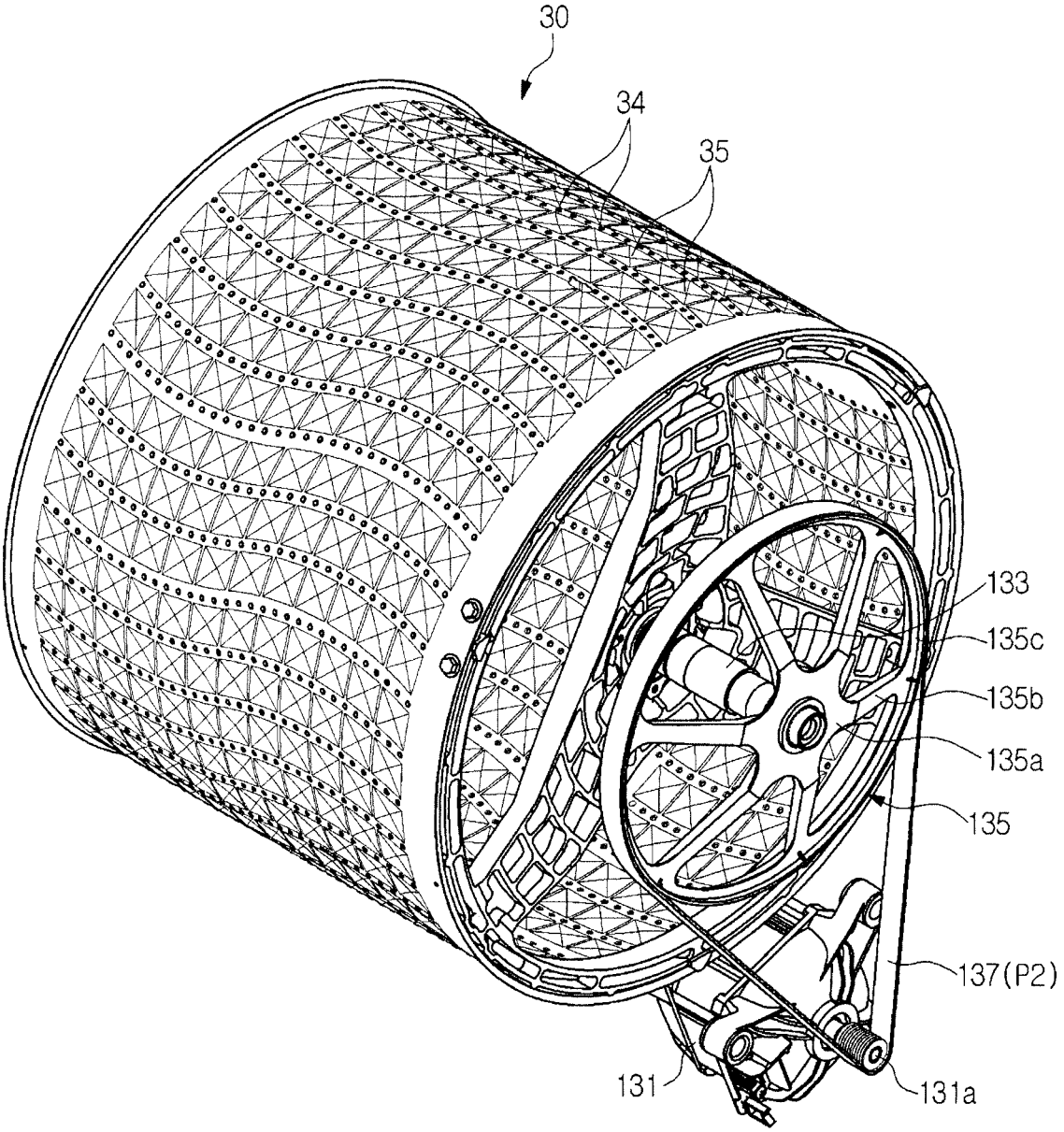
FIG. 5 is a perspective view showing the pulsator and a second driving device of the washing machine shown in FIG. 1.
Figure 6:
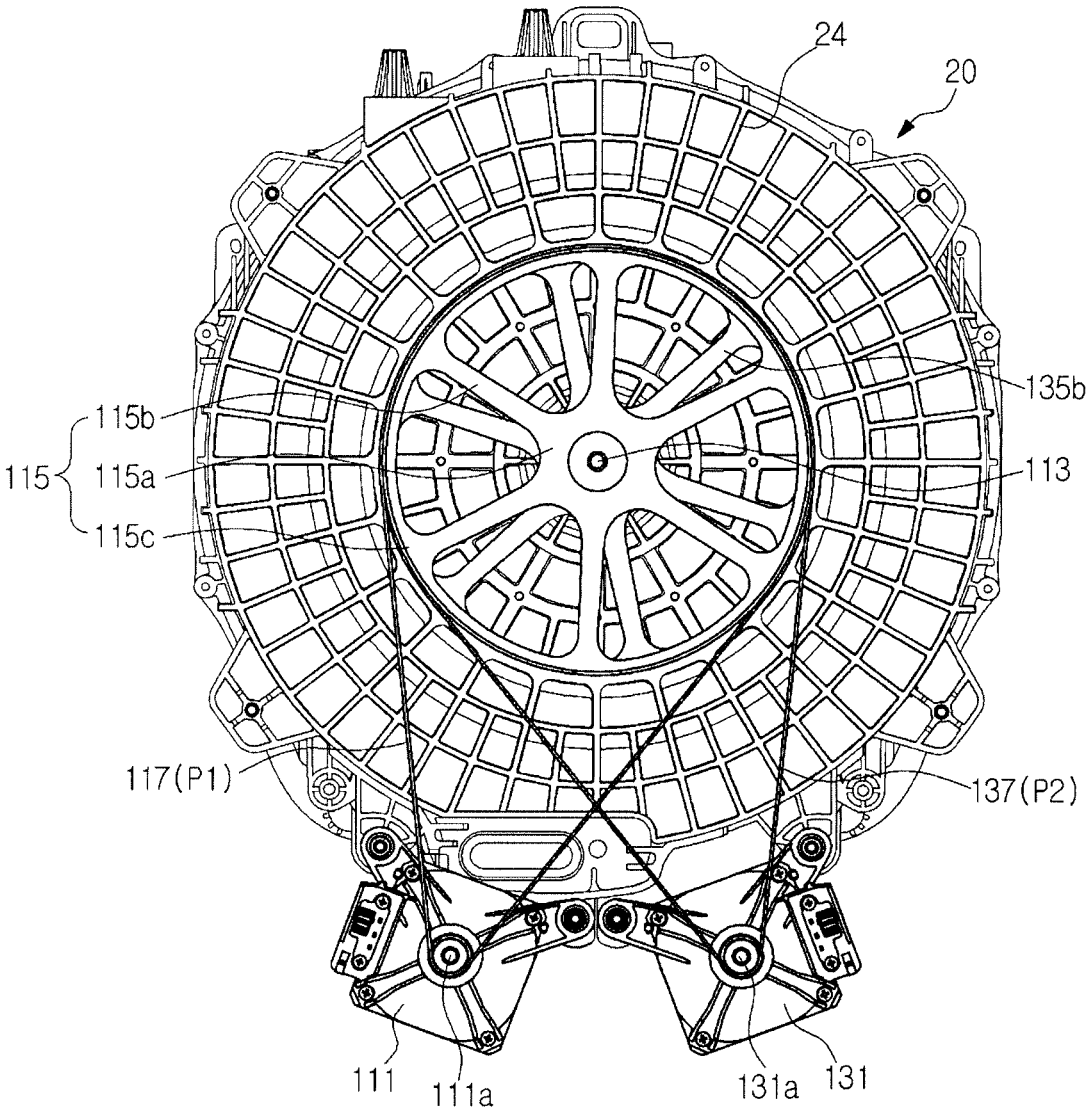
FIG. 6 shows the rear surfaces of the tub and the driving device shown in FIG. 2.

FIG. 2 is a perspective view showing a tub and a driving device of the washing machine shown in FIG. 1. FIG. 3 is a side cross-sectional view showing a drum, a pulsator, and the driving device of the washing machine shown in FIG. 1. FIG. 4 is a perspective view showing the pulsator and a first driving device of the washing machine shown in FIG. 1. FIG. 5 is a perspective view showing the pulsator and a second driving device of the washing machine shown in FIG. 1. FIG. 6 shows the rear surfaces of the tub and the driving device shown in FIG. 2. Hereinafter, FIGS. 2 to 6 will be described together in order to avoid overlapping descriptions.

In the rear portion 23 of the tub 20, a driving device 100 including the first driving device 110 for supplying power to the pulsator 40 and the second driving device 130 for supplying power to the drum 30 may be provided.

The first driving device 110 may include a first driving motor 111 for generating a rotation force for rotating the pulsator 40, a first shaft 113 extending in a rear direction from the pulsator 40 and being a rotation axis of the pulsator 40, a first pulley 115 connected to the first shaft 113, and a first belt 117 connecting the first driving motor 111 to the first pulley 115.

The first driving motor 111 may be fixed on an outer surface of the tub 20. According to an embodiment, the first driving motor 111 may be installed on a lower end portion (25) of the tub 20.

The first driving motor 111 may include a first motor shaft 111*a*, and the first motor shaft 111*a* may extend further in the rear direction of the main body 10 than a second motor shaft 131*a* of the second driving motor 131 which will be described later. According to this configuration, the washing machine 1 may be configured such that a first rotation path P1 formed by the first belt 117 connected with the first motor shaft 111*a* does not overlap with a second rotation path P2 formed by a second belt 137 connected with the second motor shaft 131*a*. That is, the first belt 117 may not interfere with the second belt 137.

The first driving motor 111 may be a motor that can rotate forward and backward. Accordingly, the first driving motor 111 may rotate the pulsator 40 in the same direction as a rotation direction of the drum 30 or in the opposite direction. The first driving motor 111 may be a Brushless DC (BLDC) motor.

The first shaft 113 may be connected to a rear surface of the pulsator 40, and extend along the rotation axis of the pulsator 40 from the pulsator 40. That is, the first shaft 113 may extend in the rear direction of the pulsator 40. As shown in FIG. 3, the first shaft 113 may be manufactured separately from the pulsator 40 and then coupled with the pulsator 40. However, the first shaft 113 may be integrated into the pulsator 40.

One end of the first shaft 113 may be connected to the pulsator 40, and the other end of the first shaft 113 may be connected to the first pulley 115 which will be described later. According to this configuration, the first shaft 113 may transfer power received by the first pulley 115 from the first driving motor 111 to the pulsator 40 to rotate the pulsator 40.

The first shaft 113 may be rotatably inserted into the inside of the second shaft 133. Accordingly, the first shaft 113 may rotate in the same direction as the second shaft 133 or in the opposite direction of the second shaft 133.

The first shaft 113 may extend longer than the second shaft 133, and be inserted into the second shaft 133 in such a way to protrude from both ends of the second shaft 133.

The first pulley 115 may be connected to the other end of the first shaft 113 that is opposite to one end of the first shaft 113 connected to the drum 30. The first pulley 115 may include a first base portion 115*a* connected to the first shaft 113, a first coupling portion 115*c* coupled with the first belt 117 which will be described later and configured to guide a rotation of the first belt 117, and a first extension portion 115*b* connecting the first base portion 115*a* to the first coupling portion 115*c*.

The other end of the first shaft 113 may be fixed on the first base portion 115*a*, and accordingly, when the first pulley 115 rotates, the first shaft 113 may also rotate together with the first pulley 115.

The first coupling portion 115*c* may be disposed along the circumference of the first pulley 115, and connected to the first belt 117. As the first coupling portion 115*c* is connected to the first belt 117, the first pulley 115 may receive a driving force generated by the first driving motor 111. The first pulley 115 may transfer the driving force received through the first coupling portion 115*c* to the first shaft 113 connected to the first base portion 115*a*.

At least one first extension portion 115*b* may extend along a radial direction of the first shaft 113 to connect the first base portion 115*a* to the first coupling portion 115*c*. However, unlike FIG. 3, the first extension portion 115*b* may be provided as a single plate extending from the first base portion 115*a* to the first coupling portion 115*c*. The first extension portion 115*b* may transfer a driving force received by the first coupling portion 115*c* from the first driving motor 111 to the first base portion 115*a*.

The first belt 117 may connect the first driving motor 111 to the first pulley 115 to transfer power of the first driving motor 111 to the first pulley 115. More specifically, the inner side of the first belt 117 may contact the first motor shaft 111*a* of the first driving motor 111 and the first coupling portion 115*c* of the first pulley 115 to be coupled with the first motor shaft 111*a* and the first coupling portion 115*c*. That is, a rotational movement of the first belt 117 may be guided by the first motor shaft 111*a* of the first driving motor 111 and the first coupling portion 115*c* of the first pulley 115.

The first belt 117 may be spaced a predetermined distance d from the second belt 137. Accordingly, the second belt 137 may not interfere with the first belt 117.

Referring to FIG. 5, the second driving device 130 may include a second driving motor 131 for generating a rotation force for rotating the drum 30, a second shaft 133 extending in the rear direction from the drum 30 and being a rotation axis of the drum 30, a second pulley 135 connected to the second shaft 133, and a second belt 137 connecting the second driving motor 131 to the second pulley 135.

The second driving motor 131 may be fixed on the outer surface of the tub 20, and provide power to the drum 30. As shown in FIG. 6, the second driving motor 131 may be installed on another end portion of the outer circumferential surface of the tub 20 than the lower end portion of the outer circumferential surface of the tub 20 on which the first driving motor 111 is fixed.

The second driving motor 131 may include the second motor shaft 131*a*, and the second motor shaft 131*a* may extend less than the first motor shaft 111*a* of the first driving motor 111 in the rear direction of the main body 10. According to this configuration, the washing machine 1 may be configured such that the second rotation path P2 formed by the second belt 137 connected with the second motor shaft 131*a* does not overlap with the first rotation path P1 formed by the first belt 117 connected with the first motor shaft 111*a*.

The second driving motor 131 may be, like the first driving motor 111, a motor that can rotate forward and backward. Accordingly, the second driving motor 131 may rotate the drum 30 in a first direction or in a second direction that is different from the first direction. The second driving motor 131 may be a BLDC motor, like the first driving motor 111.

The second shaft 133 may be connected to the rear surface of the drum 30, and extend from the drum 30 along the rotation axis of the drum 30.

The second shaft 133 may be a rotation axis of the pulsator 40. The second shaft 133 may penetrate the rear portion 23 of the tub 20 to connect the drum 30 to the second pulley 135. The second shaft 133 may be manufactured separately from the pulsator 40 and then coupled with the drum 30, although not limited to this. As another example, the second shaft 133 may be integrated into the drum 30.

On the outer circumferential surface of the second shaft 133, a second bearing 134 may be provided to rotatably support the second shaft 133. The second bearing 134 may be fixed on the tub 20.

The second shaft 133 may include a cavity into which the first shaft 113 is rotatably inserted. More specifically, the cavity of the second shaft 133 may be larger by a predetermined size than a diameter of the first shaft 113 so that the first shaft 113 can be inserted into the cavity to rotate in the cavity. According to this configuration, the second shaft 133 may rotate in the same direction as the first shaft 113 or in the opposite direction.

The second shaft 133 may be shorter than the first shaft 113 so that the first shaft 113 protrudes from both ends of the second shaft 133. According to this configuration, a rear plate of the drum 30 connected to one end of the second shaft 133 may be disposed behind the pulsator 40 connected to one end of the first shaft 113, and the second pulley 135 connected to the other end of the second shaft 133 may be closer to the drum 30 than the first pulley 115 connected to the other end of the first shaft 113.

The second pulley 135, the second base portion 135*a*, the second coupling portion 135*c*, and the second extension portion 135*b* for transferring a driving force to the drum 30 may perform the function described above in regard of the drum 30.

The second belt 137 may connect the second driving motor 131 to the second pulley 135 to transfer power of the second driving motor 131 to the second pulley 135. More specifically, the inner side of the second belt 137 may contact the second motor shaft 131*a* of the second driving motor 131 and the second coupling portion 135*c* of the second pulley 135 to be coupled with the second motor shaft 131*a* and the second coupling portion 135*c*. That is, a rotational movement of the second belt 137 may be guided by the second motor shaft 131*a* of the second driving motor 131 and the second coupling portion 135*c* of the second pulley 115.

The second belt 137 may be spaced a predetermined distance d from the first belt 117. Accordingly, the second belt 137 may not interfere with the first belt 117.

According to an embodiment, the second belt 137 may be the same belt as the first belt 117. More specifically, the second belt 137 may have the same length as the first belt 117.

In other words, the first driving motor 111, the first pulley 115, and the first belt 117 of the first driving device 110 of the washing machine 1 may be configured with the same driving motor, the same pulley, and the same belt as the second driving motor 131, the second pulley 135, and the second belt 137 of the second driving device 130.

However, the above-described components of the washing machine 1 may be disposed at different positions. For example, the drum 30 may be rotated by the first driving device 110 and the related components, and the pulsator 40 may be rotated by the second driving device 130 and the related components.

Figure 7:
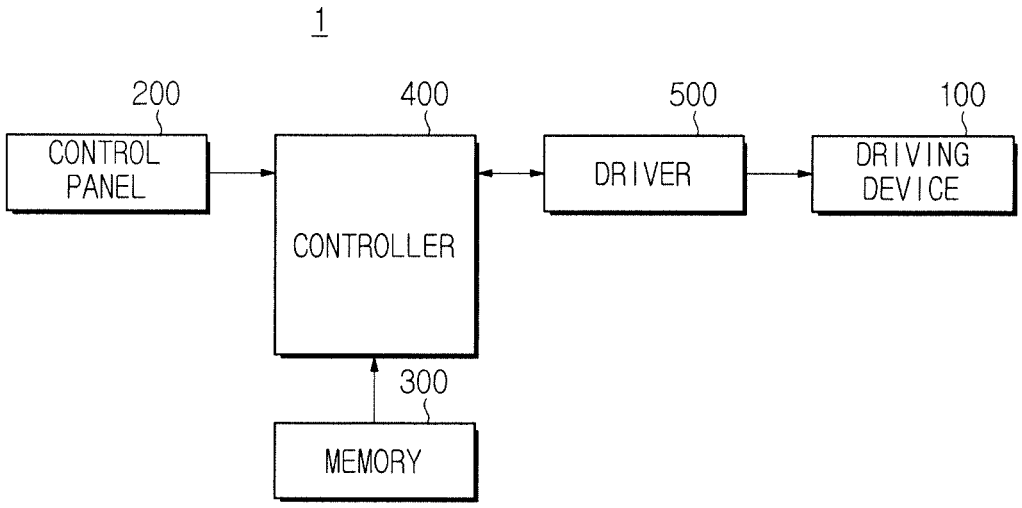
FIG. 7 is a control block diagram of a washing machine according to an embodiment of the present disclosure.
Figure 8:
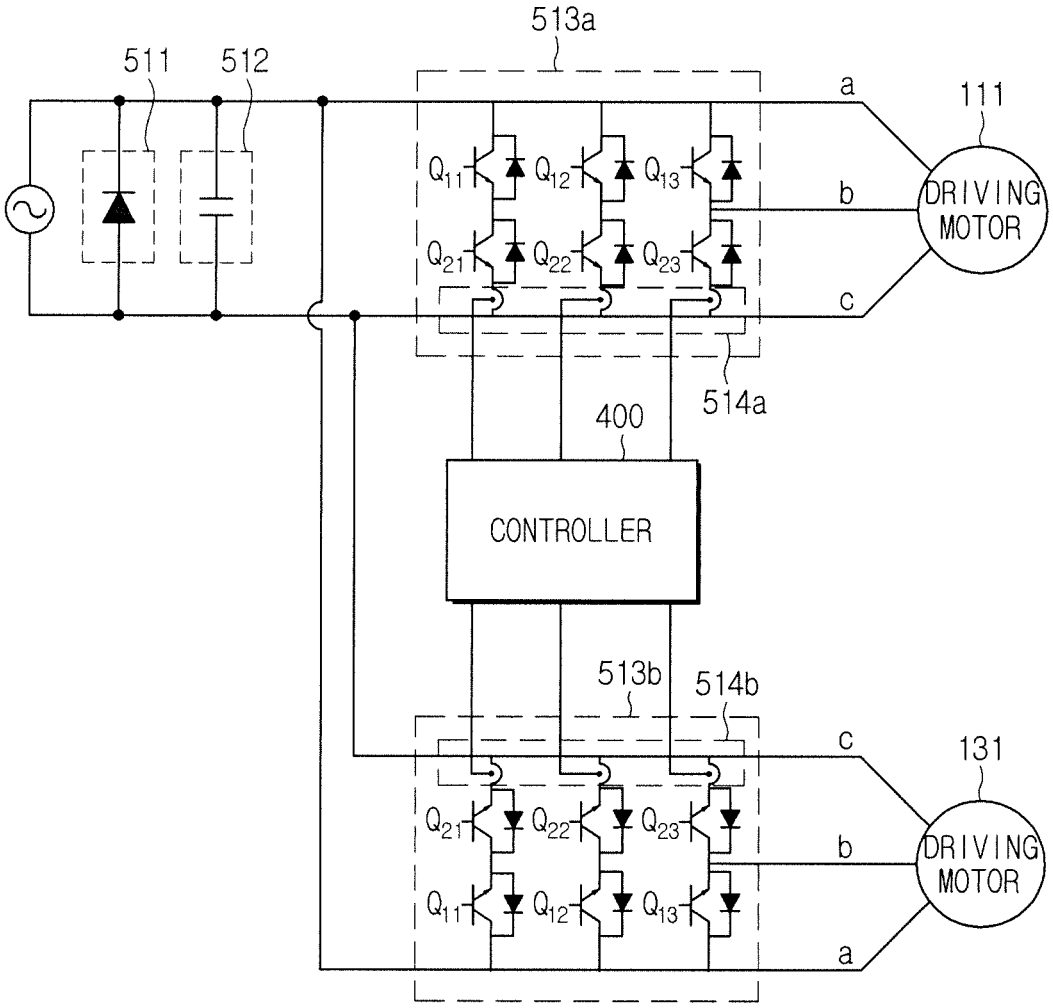
FIG. 8 is a circuit diagram of a driving circuit included in a driver of FIG. 7.

FIG. 7 is a control block diagram of a washing machine according to an embodiment of the present disclosure, and FIG. 8 is a circuit diagram of a driving circuit included in a driver of FIG. 7.

Referring to FIG. 7, the washing machine 1 may include a control panel 200 for receiving operation commands from a user, memory 300 for storing various information used for the control of the washing machine 1, the driving device 100 for supplying power to the pulsator 40 and the drum 30, a driver 500 for controlling the driving device 100, and a controller 400 for controlling the above-described components of the washing machine 1.

More specifically, the control panel 200 may receive operation commands for the washing machine 1 from the user, and display operation information of the washing machine 1 for the user. The control panel 200 may include an input device for receiving operation commands from the user, and a display for displaying operation information of the washing machine 1.

The input device may receive a power on/off command, a washing mode selection command, a water supply command, a water amount selection command, a water temperature selection command, a washing operation start/stop/end command, etc., of the washing machine 1.

Herein, the washing operation means an operation provided as a standard for guiding users by a manufacturing company, etc., and may be classified into preliminary washing, main washing, rinsing, dehydrating, etc.

The preliminary washing may be to perform first time washing for a predetermined time before main washing. The preliminary washing may be performed by putting a small amount of detergent together with water into the drum 30. The rinsing may be performed by putting water into the drum 30 without any detergent to remove the detergent included in laundry, and the rising may be performed by a predetermined number of times. The dehydrating may be to remove water stored in the drum 30, and during dehydrating, water absorbed in the laundry may be removed by mechanical energy. The washing operation which will be described below may include all of the preliminary washing, the main washing, the rinsing, and the dehydrating, or may indicate a detailed operation.

The input device may be a pressurized switch or a touch pad, and the display may be a Liquid Crystal Display (LCD) panel or a Light Emitting Diode (LED) panel.

The input device and the display of the control panel 200 may be separated from each other. However, according to another embodiment, a Touch Screen Panel (TSP) into which an input device and a display are integrated may be provided. However, the input device and the display may be implemented in various ways within a range that can be easily designed by one of ordinary skill in the art.

The memory 300 may store various data, control programs, or applications for driving and controlling the washing machine 1. For example, the memory 300 may store driving programs or applications of the washing machine 1 for controlling operations of the washing machine 1 and visually providing a control screen on the display of the control panel 200.

For example, the memory 300 may store operation order information, operation start time information, rotation direction information, etc. of the drum 30 and the pulsator 40, and may also store additional information required for controlling operations of the drum 30 and the pulsator 40.

The memory 300 according to an embodiment may store operation information about revolution per minute (rpm) of the second driving motor 131 for supplying a driving force to the drum 30 during a dehydrating operation. More specifically, the memory 300 may store operation information for increasing rpm sequentially in the order of 400 rpm, 800 rpm, and 1200 rpm after a dehydrating operation starts.

The memory 300 may be at least one kind of storage medium among a flash memory type, a hard disk type, a multimedia card micro type, card type memory (for example, Secure Digital (SD) memory or eXtreme Digital (XD) memory), Random Access Memory (RAM), Static Random Access Memory (SRAM), Read-Only Memory (ROM), Electrically Erasable Programmable Read-Only Memory (EEPROM), and Programmable Read-Only Memory (PROM), magnetic memory, a magnetic disk, and an optical disk. However, the memory 300 is not limited to the above-mentioned types, and may be implemented in various types that are known to one of ordinary skill in the art.

The driving device 100 may transfer control signals generated by the controller 400 as driving power to the drum 30 or the pulsator 40. The driving device 100 may include the first driving device 110 and the second driving device 130 described above with reference to FIGS. 1 to 6.

The first driving device 110 may drive the pulsator 40 based on a control command generated by the controller 400, and the second driving device 130 may drive the drum 30 based on a control command generated by the controller 400.

When the pulsator 40 and the drum 30 rotate in the same direction by the driving device 100, the washing machine 1 may perform the same operations as a front-loading type washing machine.

When the pulsator 40 and the drum 30 rotate in the opposite directions, the washing machine 1 may move laundry in a front-back direction as well as in an up-down direction, unlike a front-loading type washing machine that drops laundry only in the up-down direction to wash the laundry.

Also, after a washing operation starts, the washing machine 1 may start up the drum 30 and the pulsator 40 sequentially. That is, the washing machine 1 may first start up the drum 30, and after a predetermined time elapses, the washing machine 1 may start up the pulsator 40. Alternatively, the washing machine 1 may first start up the pulsator 40, and after a predetermined time elapses, the washing machine 1 may start up the drum 30.

The driver 500 may transfer power to the driving device 100 based on a control signal generated by the controller 400 to operate the driving device 100. More specifically, the driver 500 may adjust magnitudes of current flowing to the driving motors 111 and 131 included in the driving device 100 to thereby control the rpm of the driving motors 111 and 131.

The configuration and operations of the driver 500 will be described in detail with reference to FIG. 8, later.

Referring to FIG. 8, the driver 500 may include a rectifier circuit 511 for rectifying Alternating-Current (AC) power received from an external power source AC, a smoothing circuit 512 for removing ripples from the rectified power, a plurality of inverters (that is, a first inverter 513*a* and a second inverter 513*b*) for generating a driving current that is to be supplied to the driving motors 111 and 131, and a plurality of current sensing circuits 514*a* and 514*b* for sensing currents flowing between the inverters 513*a* and 513*b* and the driving motors 111 and 131.

The rectifier circuit 511 may rectify AC power of 50 Hz or 60 Hz supplied from the external power source AC. More specifically, the rectifier circuit 511 may control the polarity of an AC voltage that is applied in positive (+) and negative (−) directions such that the AC voltage is applied in the positive (+) direction, and control the direction of an AC current flowing in the positive (+) and negative (−) directions such that the AC current flows in the positive (+) direction. For example, the rectifier circuit 511 may include a diode bridge in which a plurality of diodes are connected in the form of a bridge, as shown in FIG. 8.

The smoothing circuit 512 may remove ripples of a voltage output from the rectifier circuit 511, and output a voltage of a predetermined magnitude. That is, the smoothing circuit 512 may adjust a magnitude of a voltage output from the rectifier circuit 511 to output a constant voltage. For example, the smoothing circuit 512 may include a capacitor including a pair of conductor plates that are opposite to each other and a dielectric material disposed between the pair of conductor plates, as shown in FIG. 8.

Meanwhile, the magnitude of the constant voltage (DC link voltage) output from the smoothing circuit 512 may depend on the capacity of the capacitor included in the smoothing circuit 512, and the DC link voltage may drop by an amount of current consumed by operations of the driving motors 111 and 131. That is, as the driving motors 111 and 131 consume a larger amount of current, the smoothing circuit 512 may need a larger capacity of a capacitor.

If the number of the driving motors 111 and 131 increases in order to independently control the drum 30 and the pulsator 40 included in the washing machine 1, the capacity of the capacitor included in the smoothing circuit 512 may need to increase accordingly.

When the drum 30 operates, laundry contained in the drum 30 may fall. In this case, the falling laundry may rotate the pulsator 40 which has stopped. The rotation of the pulsator 40 may generate an overcurrent in the first driving motor 111, and in this case, the DC link voltage may drop sharply. The sharp drop of the DC link voltage may cause a start-up failure or the instability of control.

In order to overcome the problem, the washing machine 1 may control a current flowing to the first driving motor 111 to 0 A so as to prevent a counter electro-motive force from being generated in the first driving motor 111. Details about the operation will be described with reference to another drawing, later.

The inverters 513*a* and 513*b* may change a DC voltage output from the smoothing circuit 512 to a pulsed three-phase AC having an arbitrary variable frequency through pulse width modulation (PWM) to control operations of the driving motors 111 and 131. For example, the inverters 513*a* and 513*b* may include a plurality of switching circuits $Q_{11}$ to $Q_{23}$, and each of the plurality of switching circuits $Q_{11}$ to $Q_{23}$ may be implemented with a free-wheeling diode and a high-voltage switch, such as a high voltage bipolar junction transistor, a high voltage field effect transistor, or an insulated gate bipolar transistor (IGBT).

The washing machine 1 may control the drum 30 and the pulsator 40 independently. Accordingly, the driver 500 may divide DC power output from the smoothing circuit 512, and transfer the divided DC power to the first inverter 513*a* for rotating the drum 30 and the second inverter 513*b* for rotating the pulsator 40, respectively.

The current sensing circuits 514*a* and 514*b* may detect a current flowing between the inverters 513*a* and 513*b* and the driving motors 111 and 131. The controller 400 may determine rpm of the driving motors 111 and 131 based on magnitudes of currents sensed by the current sensing circuits 514*a* and 514*b*.

The washing machine 1 may determine rpm of the drum 30 and the pulsator 40 through the current sensing circuits 514*a* and 514*b*. As described above, when the pulsator 40 rotates by laundry moving by a rotation of the drum 30, the current sensing circuit 514*a* may sense rpm of the pulsator 40, and the washing machine 1 may determine a current state of the laundry contained in the drum 30 based on the rpm of the pulsator 40.

The current sensing circuits 514*a* and 514*b* may include a current transformer CT for reducing a magnitude of a driving current proportionally, and an ampere meter for detecting the magnitude of the driving current reduced proportionally. That is, the current sensing circuits 514*a* and 514*b* may reduce a magnitude of a driving current proportionally using the current transformer, and then measure the magnitude of the driving current reduced proportionally to thereby detect a current.

The controller 400 may control overall operations of the washing machine 1 and signal flow between internal components of the washing machine 1, and process data. When a control command is received from a user or when a predetermined condition is satisfied, the controller 400 may execute a control program or application stored in the memory 300.

The controller 400 may control the drum 30 and the pulsator 40 according to a user's command input through the control panel 200. That is, the controller 400 may rotate the pulsator 40 and the drum 30 sequentially based on a user's command and predetermined operation information.

For example, the controller 400 may first rotate the drum 30. The rpm of the drum 30 may increase according to a predetermined time and operation information by operation information stored in the memory 300 and a control signal of the controller 400.

When rotating the drum 30, the controller 400 may control a magnitude of a current flowing to the first driving motor 111 for providing a driving force to the pulsator 40 to 0 A to suppress the generation of a counter electro-motive force.

When the rpm of the drum 30 reaches predetermined rpm, the controller 400 may operate the first driving motor 111. More specifically, the controller 400 may control the first driving motor 111 depending on the rpm of the pulsator 40 rotating relatively by laundry.

For example, when laundry rotating by the drum 30 is a small amount of load or when the laundry moves quickly, the pulsator 40 may not rotate. Since a magnitude of current flowing to the first driving motor 111 is 0 A, the rpm of the pulsator 40 may be 0 rpm. When the rpm of the drum 30 reaches predetermined rpm, the controller 400 may increase the rpm of the first driving motor 111 from 0 rpm to the current rpm of the drum 30.

According to another example, when laundry contained in the drum 30 drops, the pulsator 40 may rotate. If the pulsator 40 rotates and simultaneously the drum 30 reaches the predetermined rpm, the controller 400 may increase the rpm of the first driving motor 111 of the pulsator 40. Unlike this example, the controller 400 may calculate a rpm compensation ratio based on the actual rpm of the pulsator 40 and the rpm of the drum 30, and apply the calculated rpm compensation ratio to determine rpm of the first driving motor 111. That is, the controller 40 may increase the rpm of the first driving motor 111 based on the determine rpm.

Therefore, the washing machine 1 may prevent a DC link voltage from dropping due to a difference between the actual rpm of the pulsator 40 and the rpm of the first driving motor 111, and achieve the stability of control. Details about the operation will be described with reference to another drawing, later.

Meanwhile, the controller 400 may include at least one processor, Read Only Memory (ROM) for storing a washing machine control program or application for the control of the washing machine 1, and Random Access Memory (RAM) for storing signals or data received from the outside of the washing machine 1 or used as storage space for various tasks performed in the washing machine 1. The ROM and RAM of the controller 400 may be ROM and RAM of the memory 300.

The washing machine 1 may further include various other components in addition to the components shown in FIGS. 7 and 8, and the relative positions of the components may also change according to the performance and structure of the system.

Figure 9:
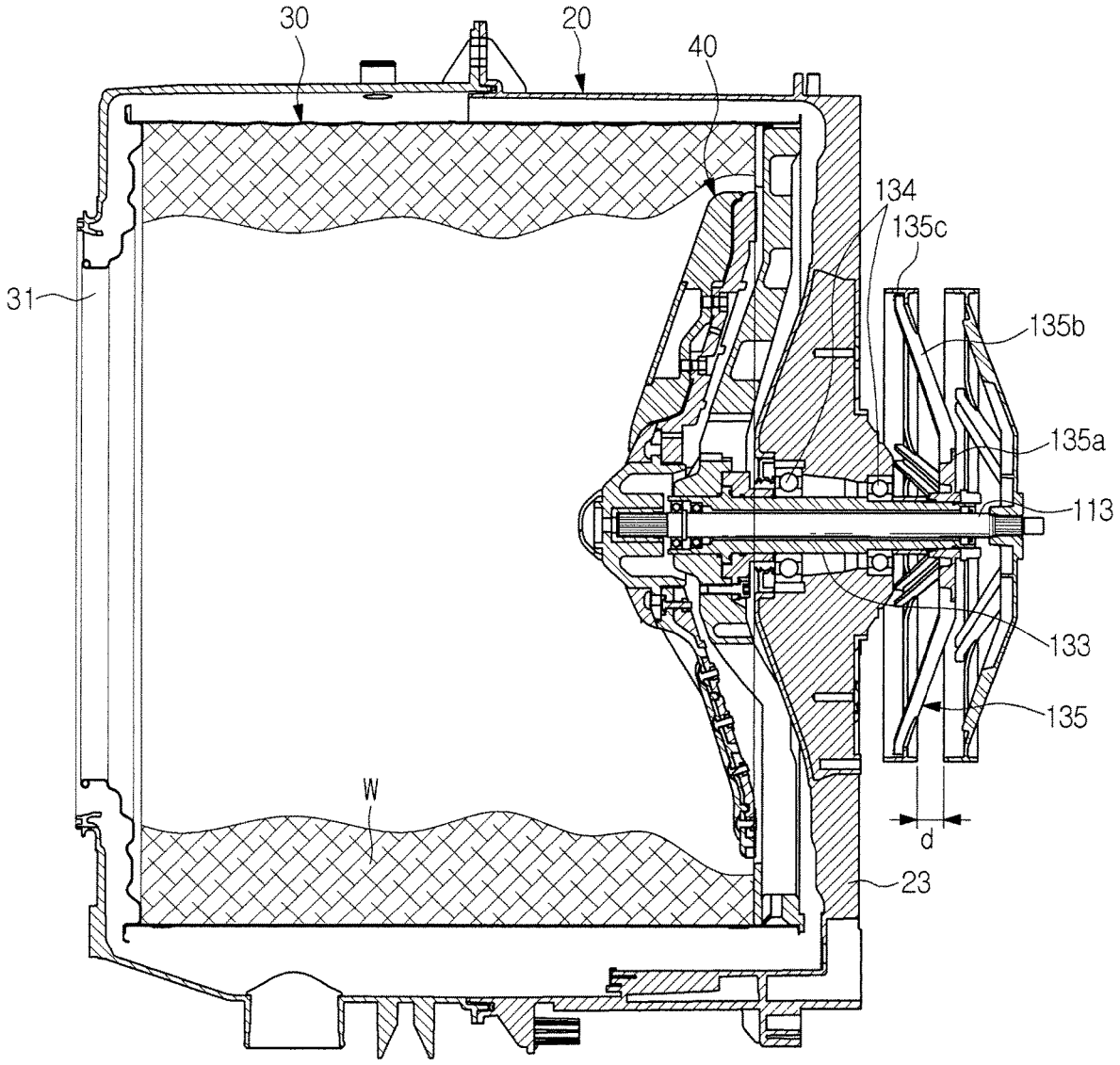
FIG. 9 is a schematic view showing a state in which laundry contained in a drum does not rub against a pulsator.
Figure 10:
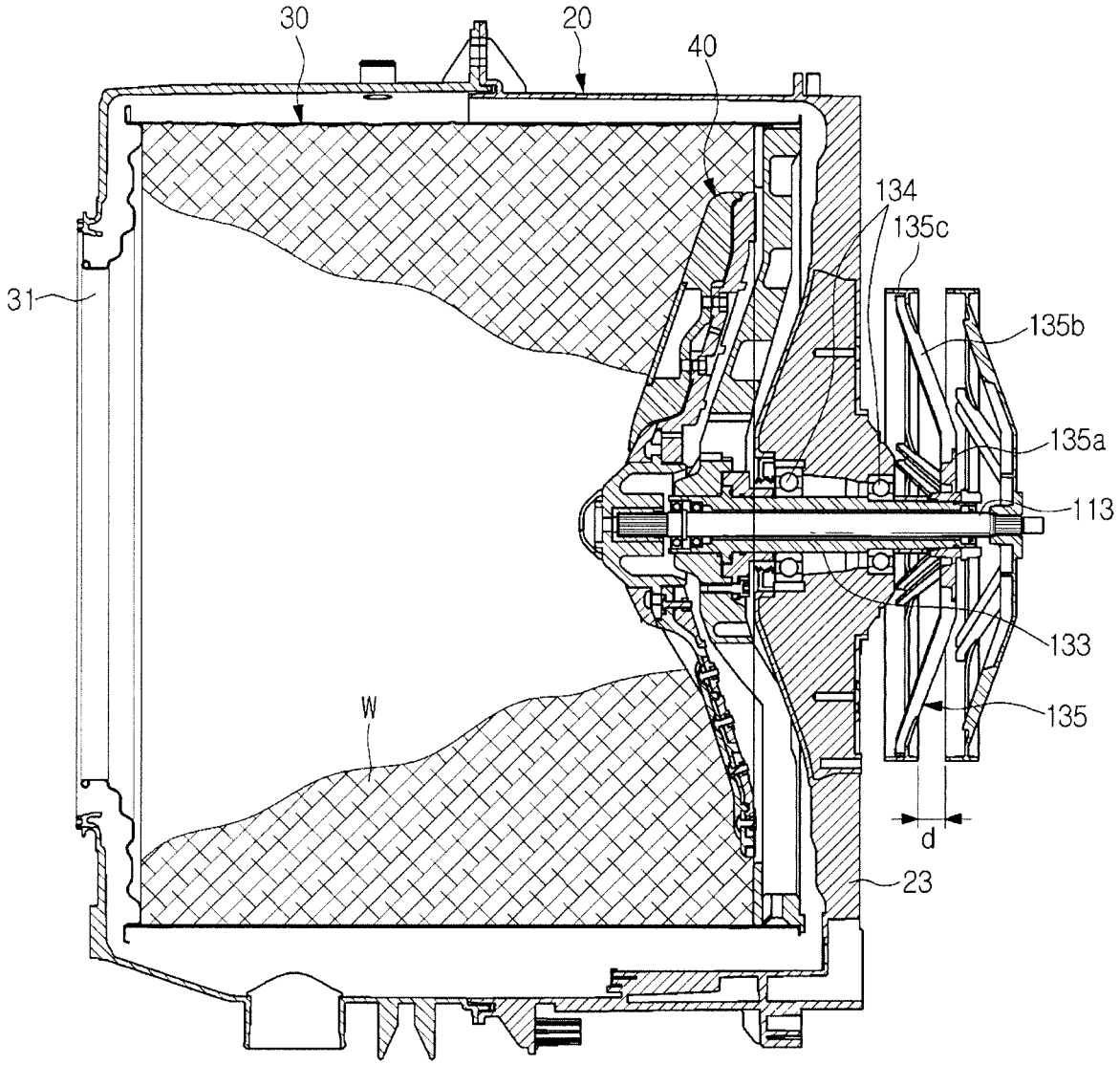
FIG. 10 is a schematic view showing a state in which laundry contained in a drum rubs against a pulsator to rotate the pulsator.
Figure 11:
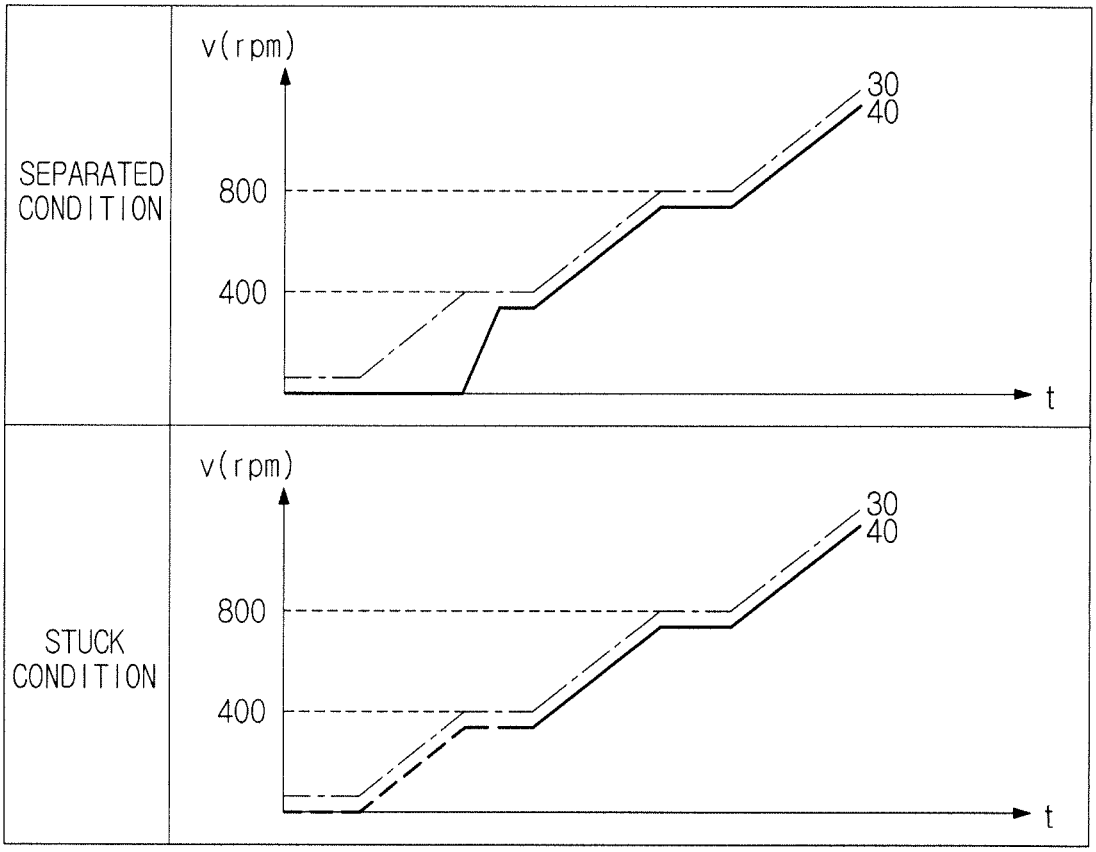
FIG. 11 is a view for describing operations of a washing machine in the states shown in FIGS. 9 and 10.

FIG. 9 is a schematic view showing a state in which laundry contained in the drum does not rub against the pulsator, FIG. 10 is a schematic view showing a state in which laundry contained in the drum rubs against the pulsator to rotate the pulsator, and FIG. 11 is a view for describing operations of the washing machine in the states shown in FIGS. 9 and 10.

Referring first to FIG. 9, the controller 400 may receive a command from a user to execute a washing operation. For example, the controller 400 may receive a washing operation start command for dehydration from a user, and generate a control signal for rotating the drum 30 to control the driver 500.

The driver 500 may operate the second inverter 513*b* based on the control command from the controller 400 to drive the second driving motor 131. The drum 30 may rotate by the second driving motor 131. Simultaneously, the controller 400 may control a current flowing to the first driving motor 111 for providing a driving force to the pulsator 40 to 0 A.

When the drum 30 rotates, laundry W contained in the drum 30 may drop repeatedly. When the laundry W drops, the pulsator 40 may rotate. The controller 400 may determine whether the pulsator 40 rotates, based on a current of a counter electro-motive force sensed by the first sensing circuit 514*a*.

More specifically, when the detected rpm of the pulsator 40 is higher than reference rpm, the controller 400 may determine that the pulsator 40 rotates by the laundry W. Herein, the reference rpm may be set arbitrarily, and may change by a load of the laundry W input by the user.

Meanwhile, when the laundry W is a small amount of load or when the laundry W scarcely rubs against the protruding pulsator 40, the pulsator 40 may not rotate. That is, in the state shown in FIG. 9, the drum 30 may rotate by the second driving motor 131, and the pulsator 40 may stop without rotating. Hereinafter, the state shown in FIG. 9 will be referred to as a separated condition.

Referring to FIG. 10, the washing machine 1 may operate the second driving motor 131 for rotating the drum 30. When the drum 30 rotates to drop laundry W repeatedly, the laundry W may rotate the pulsator 40 if the laundry W is a large amount of load or if the laundry W gets tangled or moves randomly, as shown in FIG. 10. Hereinafter, the state shown in FIG. 10 will be referred to as a stuck condition.

In the stuck condition, the pulsator 40 may have rpm by the laundry W. The washing machine 1 may generate a counter electro-motive force in the first driving motor 111 when the pulsator 40 rotates. When the pulsator 40 rotates, a current may flow between the first driving motor 111 and the second inverter 513*a*. The first current sensing circuit 514*a* may sense the current, and transfer the sensed current to the controller 400. In order to reduce the counter electro-motive force, the washing machine 1 may generate a current for reducing the generated counter electro-motive force, and apply the current to the first driving motor 111. Thereby, the washing machine 1 may maintain a current flowing to the first driving motor 111 at 0 A.

Meanwhile, since the washing machine 1 maintains a current flowing to the first driving motor 111 at 0 A even in the stuck condition, the pulsator 40 may continue to have constant rpm.

Referring to FIG. 11, the washing machine 1 may perform different control methods in the separated condition and the stuck condition.

When a dehydrating operation starts, the washing machine 1 may increase the rpm of the drum 30 sequentially, as shown in FIG. 11. That is, the rpm of the second driving motor 131 rotating the drum 30 may increase at regular time intervals to 0 rpm, 400 rpm, and 800 rpm in this order.

In the separated condition, the pulsator 40 may not rotate or may rotate at rpm that is lower than reference rpm, by zero-current control.

Meanwhile, when the rpm of the drum 30 continues to increase, kinetic energy of the laundry W contained in the drum 30 may increase. Even in the separated condition, the laundry W may rub against the protruding portion of the pulsator 40. That is, the increased kinetic energy of the laundry W may be converted into thermal energy when the laundry W rubs against the pulsator 40, and the thermal energy may damage the laundry W.

In order to prevent the laundry W from being damaged, the washing machine 1 may operate the first driving motor 111 for driving the pulsator 40 when the drum 30 rotates at 400 rpm or higher. More specifically, the washing machine 1 may increase the rpm of the first driving motor 111 to the current rpm of the drum 30, and then control the first driving motor 111 to the same rpm as the second driving motor 131 for operating the drum 30.

Meanwhile, the predetermined rpm shown in FIG. 11, that is, 400 rpm may be an example, and may change to other values.

In the stuck condition, the pulsator 40 may rotate at rpm that is higher than the predetermined rpm by the laundry W. In a graph of the stuck condition shown in FIG. 11, a dotted line shows the rpm of the pulsator 40 changed by the laundry W.

When the pulsator 40 rotates, a counter electro-motive force may be generated in the first driving motor 111 connected to the pulsator 40. An overcurrent caused by the generation of the counter electro-motive force may flow to the driver 500 to thus damage the control circuit.

General methods for suppressing the generation of a counter electro-motive force may include open brake control, short brake control, and field-weakening control.

More specifically, the short brake control may be a method of short-circuiting all of the six switches $Q_{11}$ to $Q_{23}$ included in the first inverter 513*a*. When the switches $Q_{11}$ to $Q_{23}$ are short-circuited, the pulsator 40 may stop rotating forcedly. However, due to the braking power of the first driving motor 111, a load of the second driving motor 131 that uses the same voltage output from the smoothing circuit 512 may increase. Therefore, the short brake control may deteriorate the dehydrating performance of the washing machine 1.

The open brake control may open all of the six switches $Q_{11}$ to $Q_{23}$ included in the first inverter 513*a*. In this case, the first driving motor 111 may operate as a generator by a rotation of the pulsator 40, and a current generated by a counter electro-motive force may be applied to the second inverter 513*b* and the second driving motor 131 through the diode included in the first inverter 513*a*. That is, a phase difference may be generated between a current applied by a counter electro-motive force and a current for the control of the second driving motor 131, thereby causing a problem in current sensing. As a result, the open brake control may interfere with efficient control of the second driving motor 131.

The field-weakening control may apply the same current as that applied to the first driving motor 111 to the second driving motor 131 to weaken torque. However, the field-weakening control may have difficulties in coping with a sharp increase of a DC link voltage by a counter electro-motive force that is generated when the pulsator 40 rotates at very high rpm, for example, 400 rpm.

In order to resolve the above-described problems of the short brake control, the open brake control, and the field-weakening control, the washing machine 1 may stop zero-current control when the rpm of the drum 30 increases to 400 rpm or higher in the stuck condition, and the controller 400 may directly control the rpm of the first driving motor 111. Also, the controller 400 may control the rpm of the first driving motor 111 based on the rpm of the second driving motor 131 for driving the drum 30.

That is, when the rpm of the pulsator 40 increases to 400 rpm or higher by the laundry W, the washing machine 1 may apply a control signal to the first driving motor 111 to control the first driving motor 111 to the same rpm as the second driving motor 131.

Meanwhile, the 400 rpm set in the stuck condition is only an example, and arbitrary rpm may be set.

Figure 12:
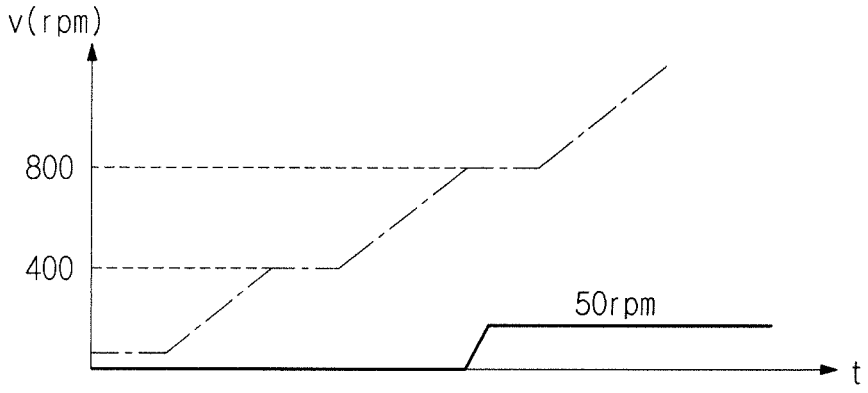
FIG. 12 is a view for describing another problem according to Revolution Per Minute (rpm) control of a pulsator in a stuck condition.

FIG. 12 is a view for describing another problem according to rpm control of the pulsator in the stuck condition.

After a predetermined time elapses in the stuck condition, the washing machine 1 may control the rpm of the first driving motor 111 to constant rpm, for example, 50 rpm.

In this case, when the rpm of the drum 30 increases, a difference between the rpm of the drum 30 and the relative rpm of the pulsator 40 may increase. When the relative rpm of the pulsator 40 increases, a friction force between the pulsator 40 and the laundry W may further increase, which may damage the laundry W.

As described above with reference to FIG. 11, the washing machine 1 may control the rpm of the first driving motor 111 for providing a driving force to the pulsator 40 to the same rpm as that of the second driving motor 131 in the stuck condition, thereby solving the above-described problem.

Figure 13:
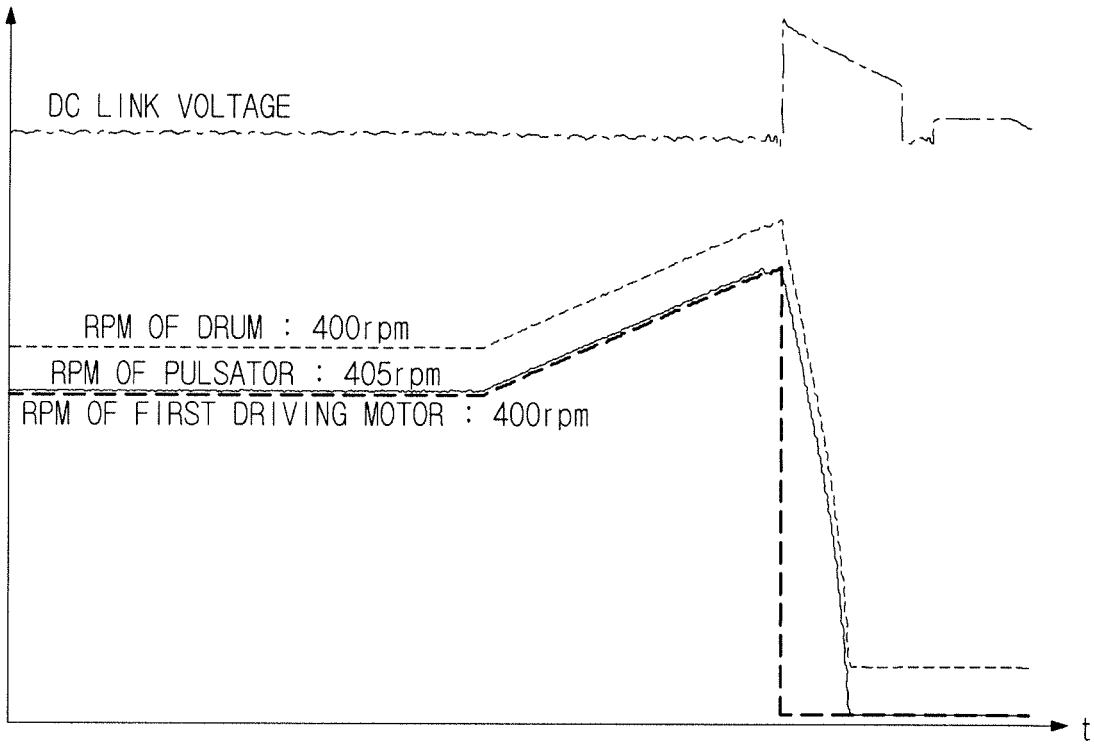
FIGS. 13 and 14 are views for describing a problem that is generated in rpm control of a pulsator in a stuck condition.
Figure 14:
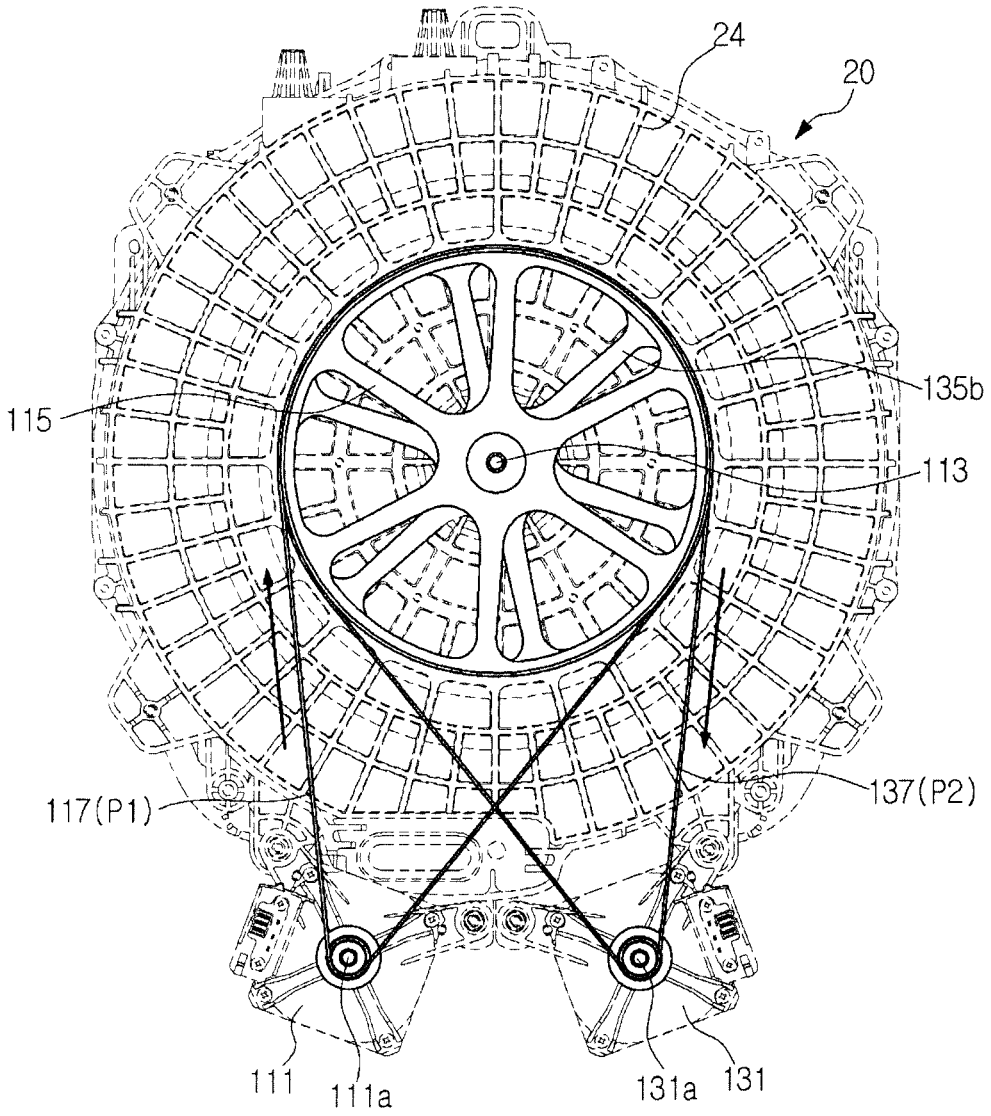

FIGS. 13 and 14 are views for describing a problem that is generated in rpm control of a pulsator in the stuck condition.

As described above with reference to FIG. 11, the washing machine 1 may control the rpm of the first driving motor 111 for driving the pulsator 40 based on the rpm of the second driving motor 131 for driving the drum 30, in the stuck condition.

The drum 30 may rotate at 400 rpm by the second driving motor 131 for rotating the drum 30. Although the washing machine 1 operates the first driving motor 111 at 400 rpm in order to control the rpm of the pulsator 40 to the same rpm as that of the drum 30, the actual rpm of the pulsator 40 may be 405 rpm in the stuck condition.

Referring to FIG. 14, although the controller 400 rotates the first driving motor 111 and the second driving motor 131 to the same control signal, for example, to 400 rpm, the actual rpm of the pulsator 40 may be different from the rpm of the first driving motor 111 by mechanical errors according to the configurations and lengths of the pulleys 113 and 115 and the belts 117 and 137 or the kinetic energy of laundry W rotating by the drum 30.

Accordingly, the pulsator 40 may rotate with a rotation force that is greater than a control signal of the controller 400, and a difference between the actual rpm of the pulsator 40 and the rpm of the first driving motor 111 may increase the DC link voltage instantaneously so as for the pulsator 40 to get out of control, as shown in FIG. 13.

In order to overcome the problem, the washing machine 1 may calculate rpm of the first driving motor 111 as rpm that is different from that of the second driving motor 131, in the stuck condition.

Figure 15:
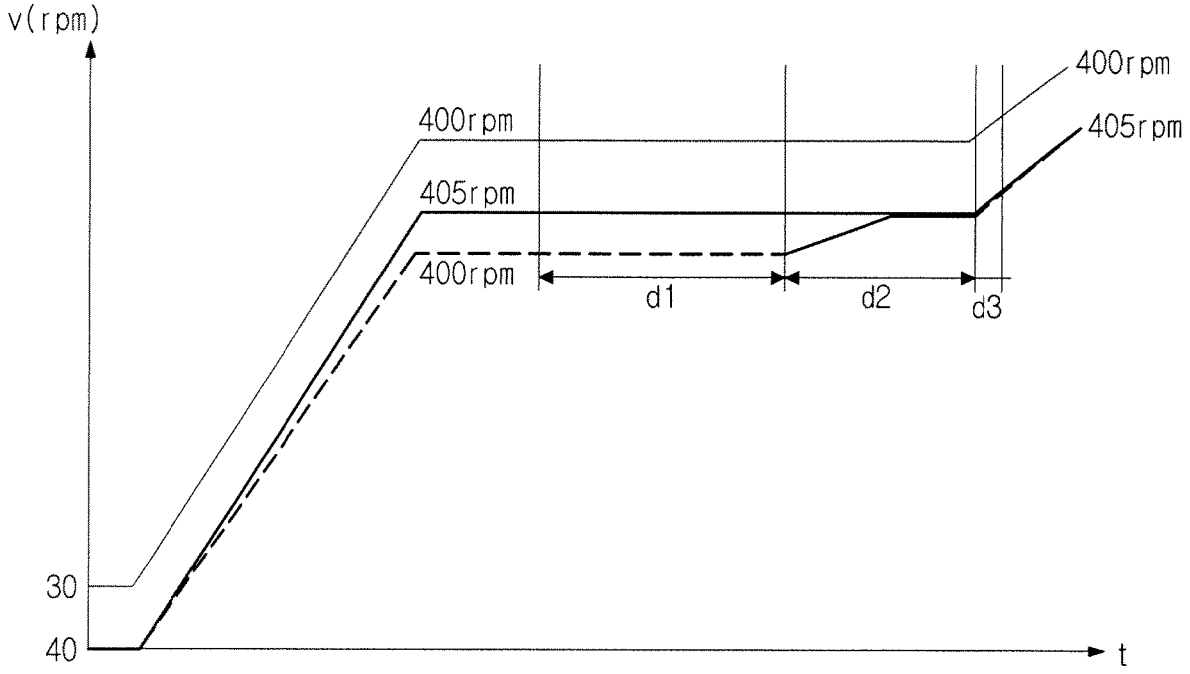
FIG. 15 is a view for describing a rpm compensation method according to an embodiment of the present disclosure.

FIG. 15 is a view for describing a rpm compensation method according to an embodiment of the present disclosure.

Referring to FIG. 15, the controller 400 may monitor the rpm of the pulsator 40 caused by the laundry W based on the result of detection transferred from the first current sensing circuit 513*a*.

When the rpm of the drum 30 or the rpm of the pulsator 40 is higher than 400 rpm which is predetermined rpm, the controller 400 may calculate a rpm compensation ratio based on the current rpm of the pulsator 40 and the rpm of the drum 30, in a section d1.

The rpm compensation ratio may be calculated by Equation 1 below.

$$\text{rpm compensation ratio } (\alpha) = (\text{rpm of the pulsator})/(\text{rpm of the drum}) \quad \text{[Equation 1]}$$

In the example of FIG. 15, the rpm compensation ratio $\alpha$ may be 1.0125. The controller 400 may determine the rpm compensation ratio $\alpha$ in the section d1, and calculate rpm of the first driving motor 111 to which the rpm compensation ratio $\alpha$ is applied. The rpm of the first driving motor 111 may be calculated by Equation (2) below.

$$\text{rpm of the first driving motor} = (\text{rpm of the drum}) = (\text{rpm compensation ratio } \alpha) \quad \text{[Equation 2]}$$

In the example of FIG. 15, the rpm of the first driving motor 111 may be calculated as 405 rpm.

The controller 400 may control the first driving motor 111 based on the calculated rpm of the first driving motor 111, in a section d2. That is, in the stuck condition, the controller 400 may transfer different control signals to the first driving motor 111 and the second driving motor 131, respectively.

Also, after calculating the rpm compensation ratio $\alpha$, the controller 400 may continue to generate a control signal related to the rpm of the first driving motor 111 at predetermined time intervals d3. That is, in a section in which the rpm of the drum 30 increases from 400 rpm to 800 rpm, the controller 400 may apply a rpm compensation ratio calculated per 1 ms (d3) to calculate rpm for controlling the first driving motor 111, and apply the calculated rpm to the first driving motor 111.

Meanwhile, 1 ms may be a predetermined time period, and may change to another time period.

Figure 16:
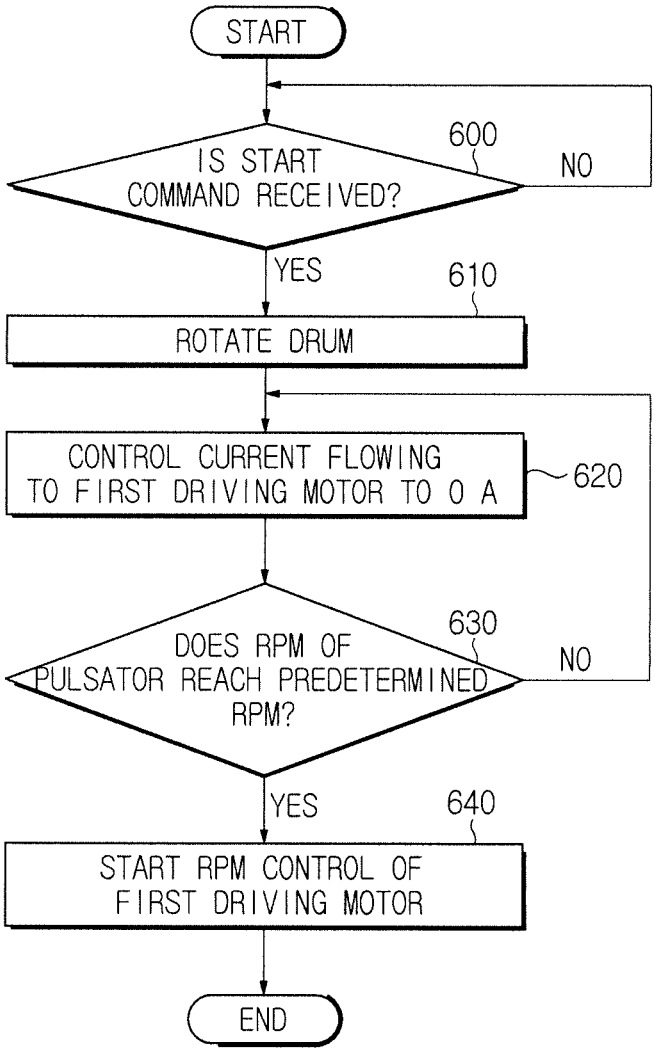
FIG. 16 is a flowchart for describing a control method of a washing machine according to an embodiment of the present disclosure.

FIG. 16 is a flowchart for describing a control method of a washing machine according to an embodiment of the present disclosure.

Referring to FIG. 16, it may be determined whether a washing operation start command is received, in operation 600. Then, a rotation of the drum 30 may be controlled, in operation 610, and a current flowing to the first driving motor 111 may be controlled to 0 A, in operation 620.

The washing operation start command may be a dehydrating operation start command. The dehydrating operation may start by a predetermined operation method or by a user's command. However, the washing operation start command is not limited to the dehydrating operation start command, and may be another washing operation start command.

When a dehydrating operation starts, the controller 400 may control the second driving motor 131 to operate the drum 30. If the second driving motor 131 operates, the drum 30 may rotate, and the pulsator 40 may rotate by laundry W contained in the drum 30. When the pulsator 40 rotates, a counter electro-motive force may be generated in the first driving motor 111. As described above, the controller 400 may control a current flowing to the first driving motor 111 to 0 A in order to prevent the first driving motor 111 from being damaged by the counter electro-motive force.

That is, if a current flowing to the first driving motor 111 is controlled to 0 A, the pulsator 40 may rotate or not rotate according to a load of the laundry W.

Thereafter, the controller 400 may determine whether the rpm of the pulsator 40 reaches predetermined rpm, in operation 630.

When the rpm of the pulsator 40 reaches the predetermined rpm, the controller 400 may start rpm control of the first driving motor 111, in operation 640.

More specifically, in the separated condition, the controller 400 may start rpm control of the first driving motor 111 based on the rpm of the drum 30. Meanwhile, in the stuck condition, the controller 400 may start rpm control of the first driving motor 111 in consideration of the rpm of the drum 30 and the sensed rpm of the pulsator 40. Details about the operation will be described with reference to FIG. 17, later.

Meanwhile, if the rpm of the drum 30 or the pulsator 40 does not reach the predetermined rpm, the controller 400 may continue to control the current flowing to the first driving motor 111 to 0 A.

Figure 17:
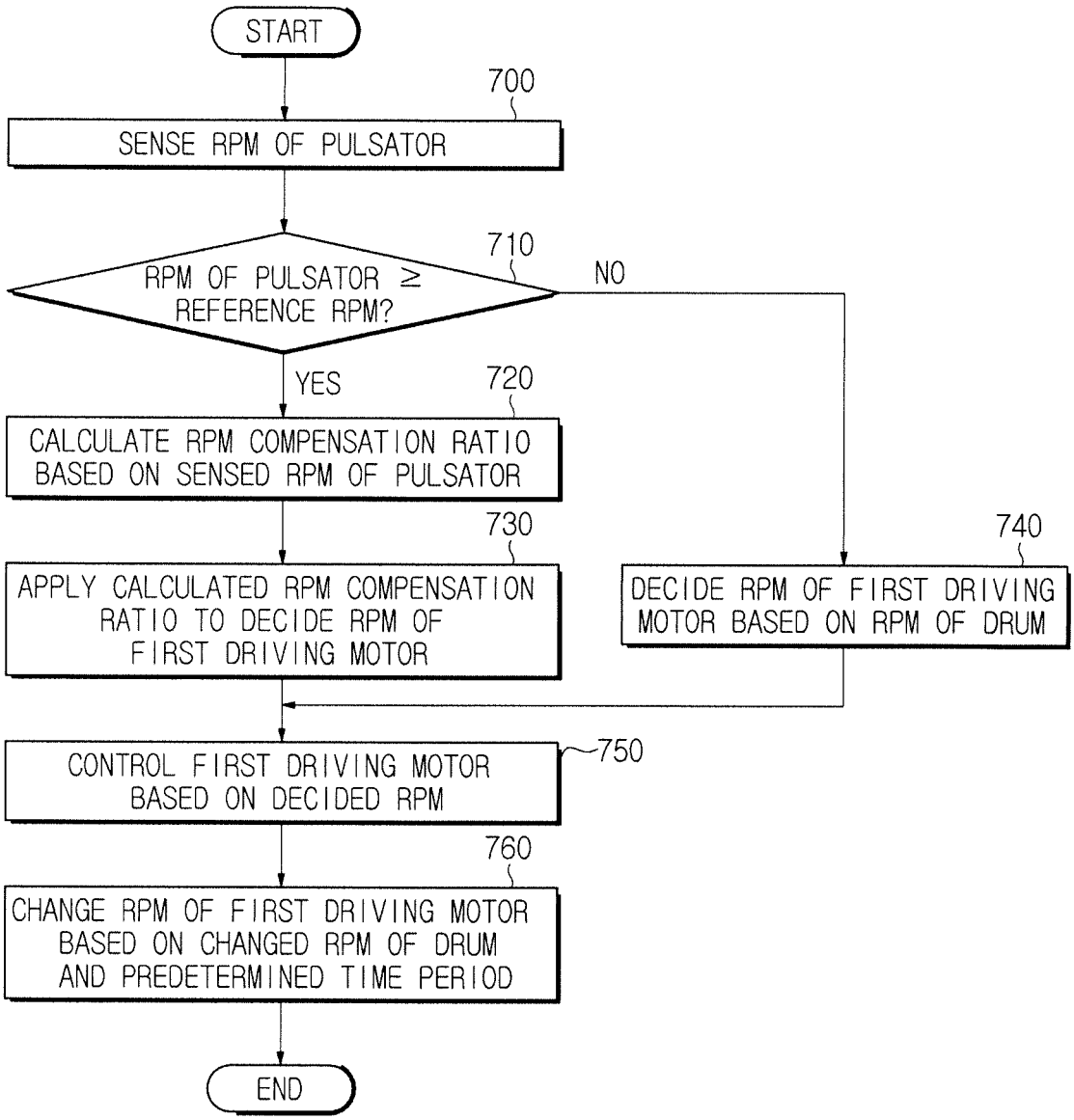
FIG. 17 is a flowchart for describing a control method of a washing machine according to an embodiment of the present disclosure.

FIG. 17 is a flowchart for describing a control method of the washing machine according to an embodiment of the present disclosure.

Referring to FIG. 17, the controller 400 may sense rpm of the pulsator 40, in operation 700.

The controller 400 may determine the rpm of the pulsator 40 based on the result of sensing by the first current sensing circuit 514*a*.

Then, the controller 400 may compare the determined rpm of the pulsator 40 to reference rpm, in operation 710.

If the rpm of the pulsator 40 is higher than or equal to the reference rpm, the controller 400 may determine the stuck condition in which the pulsator 40 rotates by laundry W. In this case, the controller 400 may calculate a rpm compensation ratio based on the sensed rpm of the pulsator 40, in operation 720.

More specifically, the rpm compensation ratio may be calculated by the determined rpm of the pulsator 40 and the rpm of the drum 30. As described above, the rpm of the drum 30 may be criteria based on which the controller 400 controls the first driving motor 111. Accordingly, the controller 400 may calculate the rpm compensation ratio based on the rpm of the drum 30 and the current rpm of the pulsator 40.

The controller 400 may apply the calculated rpm compensation ratio to determine rpm of the first driving motor 111, in operation 730. The controller 400 may control the first driving motor 111 based on the determined rpm, in operation 750.

Unlike this, if the rpm of the pulsator 40 is lower than the reference rpm, the controller 400 may determine the separated condition. Unlike the stuck condition, the controller 400 may decide rpm of the first driving motor 111 based on the rpm of the drum 30, that is, the rpm of the second driving motor 131, in operation 740. In the separated condition, the controller 400 may operate the first driving motor 111 based on the determined rpm, in operation 750.

Meanwhile, the controller 400 may change the rpm of the first driving motor 111 based on the rpm of the drum 30 and a predetermined time period, in operation 760.

More specifically, in the stuck condition, the controller 400 may determine rpm of the first driving motor 111 in consideration of the rpm of the drum 30 and the rpm compensation ratio calculated in advance according to the predetermined time period, and apply the determined rpm to the first driving motor 111. However, in the separated condition, when the rpm of the drum 30 changes, the controller 400 may change the rpm of the first driving motor 111 accordingly.

Thereby, the washing machine 1 may prevent abnormal noise due to the instability of control of the pulsator 40 when the drum 30 rotates, prevent laundry from being damaged when the laundry contacts the pulsator 40 due to a high-speed synchronized operation of the drum 30 and the pulsator 40, and prevent a breakdown of the driving device 100, which may be caused when the drum 30 operates alone, thereby performing stable control.

According to the washing machine of an aspect of the present disclosure and the control method thereof, it may be possible to prevent abnormal noise that is caused by the instability of control of the pulsator when the drum rotates.

According to the washing machine of another aspect of the present disclosure and the control method thereof, it may be possible to prevent laundry from being damaged when the laundry contacts the pulsator due to a high-speed synchronized operation of the drum and the pulsator.

Also, by preventing the instability of control of the drum that is caused by the pulsator, it may be possible to increase the stability of control of the drum.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a main body having a laundry inlet in a front portion of the main body;

a tub disposed inside the main body;

a drum rotatably disposed inside the tub;

a pulsator disposed inside the drum, and being rotatable relative to the drum;

a motor configured to provide a driving force to the pulsator, to thereby control rotation of the pulsator; and a controller configured to perform a first control process of controlling a current flowing to the motor, in accordance with rotation of the pulsator by movement of laundry in the drum and that generates counter electromotive force in the motor, to thereby suppress the counter electromotive force, and after performing the first control process, perform a second control process of controlling the motor in accordance with rotation of the drum, to thereby control the driving force provided to the pulsator.

2. The washing machine according to claim 1, wherein, in the first control process, revolution per minute (rpm) of the pulsator is lower than a reference rpm.

3. The washing machine according to claim 1, wherein, in the second control process, when revolution per minute (rpm) of the pulsator is higher than or equal to a reference rpm, the controller:

calculates a rpm compensation ratio on the basis of the rpm of the pulsator and rpm of the drum, and controls the motor in accordance with the calculated compensation ratio, to thereby control the driving force provided to the pulsator.

4. The washing machine according to claim 3, wherein, in the second process, the controller determines rpm of the motor on the basis of the calculated compensation ratio, and controls the motor on the basis of the determined rpm of the motor, to thereby control the driving force provided to the pulsator.

5. The washing machine according to claim 4, wherein, in the second control process, the controller:

recalculates the compensation ratio on the basis of a predetermined time period, and controls the motor in accordance with the recalculated compensation ratio.

6. The washing machine according to claim 1, wherein, in the second control process, the controller controls the motor in accordance with rotation of the drum by changing revolution per minute (rpm) of the motor in accordance with rpm of the drum.

7. The washing machine according to claim 1, further comprising:

a first driving device configured to rotate the motor;

an additional motor to provide a driving force to the drum, to rotate the drum; and a second driving device configured to rotate the additional motor, to thereby control the driving force provided to the drum.

8. The washing machine according to claim 7, further comprising:

a control panel configured to receive a washing operation start command from a user, wherein the controller controls the second driving device and the first driving device sequentially in accordance with the washing operation start command being received by the control panel.

9. The washing machine according to claim 1, wherein the controller determines the rotation of the pulsator by movement of laundry in the drum based on current flowing to the motor.

10. The washing machine according to claim 1, wherein the controller is configured to control the drum and the pulsator such that the drum and the pulsator rotate in different directions.

11. The washing machine according to claim 1, wherein the controller is configured to change from performing the first control process to performing the second control process when the pulsator is at or above a specific revolution per minute.

12. The washing machine according to claim 1, wherein the controller is configured to change from performing the first control process to performing the second control process when the drum is at or above a specific revolution per minute.

13. A method performed by a washing machine that includes a drum, a pulsator disposed inside the drum and being rotatable relative to the drum, and a motor configured to provide a driving force to the pulsator to thereby control rotation of the pulsator, the method comprising:

by the washing machine:

performing a first control process of controlling a current flowing to the motor, according to rotation of the pulsator by movement of laundry in the drum and that generates counter electromotive force in the motor, to thereby suppress the counter electromotive force; and after performing the first control process, performing a second control process of controlling the motor in accordance with rotation of the drum, to thereby control the driving force provided to the pulsator.

14. The method according to claim 13, wherein, in the first control process, revolution per minute (rpm) of the pulsator is lower than a reference rpm.

15. The method according to claim 13, wherein, in the second control process, when revolution per minute (rpm) of the pulsator is higher than or equal to reference rpm, the washing machine calculates a rpm compensation ratio on the basis of the rpm of the pulsator and rpm of the drum, and controls the motor in accordance with the calculated compensation ratio, to thereby control the driving force provided to the pulsator.

16. The method according to claim 15, wherein, in the second control process, the washing machine:

determines rpm of the motor on the basis of the calculated compensation ratio; and controls the motor on the basis of the determined rpm of the motor, to thereby control the driving force provided to the pulsator.

17. The method according to claim 16, wherein, in the second control process, the washing machine recalculates the compensation ratio on the basis of a predetermined time period, and controls the motor in accordance with the recalculated compensation ratio.

18. The method according to claim 13, wherein, in the second control process, the washing machine controls the motor in accordance with rotation of the drum by changing revolution per minute (rpm) of the motor in accordance with rpm of the drum.

19. The method according to claim 13, wherein, in the second control process, the washing machine controls the drum and the pulsator so that the drum and the pulsator rotate in different directions.

20. A washing machine comprising:

a drum that is rotatable;

a pulsator disposed inside the drum, and that is rotatable relative to the drum;

a motor configured to provide a driving force to the pulsator, to thereby control rotation of the pulsator; and a controller configured to, with a rotation speed of the drum being below a predetermined rotation speed for the drum and a rotation speed of the pulsator being below a predetermined rotation speed for the pulsator, and in response to a rotation of the pulsator that generates a counter electromotive force in the motor, control a current flowing to the motor to suppress the counter electromotive force, and when the rotation speed of the drum increases to be above the predetermined rotation speed for the drum, or when the rotation speed of the pulsator rotates to be above the predetermined rotation speed for the pulsator, control the motor in accordance with rotation of the drum, to thereby control the driving force provided to the pulsator.

* * * * *